US011035076B2

(12) United States Patent
Minhas et al.

(10) Patent No.: US 11,035,076 B2
(45) Date of Patent: Jun. 15, 2021

(54) SURFACE-MODIFIED CELLULOSIC MATERIALS AND METHODS OF PRODUCING THE SAME

(71) Applicant: PERFORMANCE BIOFILAMENTS INC., Vancouver (CA)

(72) Inventors: Gurminder Minhas, Burnaby (CA); Keith Gourlay, Vancouver (CA)

(73) Assignee: PERFORMANCE BIOFILAMENTS INC., Vancouver (CA)

( * ) Notice: Subject to any disclaimer, the term of this patent is extended or adjusted under 35 U.S.C. 154(b) by 24 days.

(21) Appl. No.: 16/312,965

(22) PCT Filed: Jun. 22, 2017

(86) PCT No.: PCT/CA2017/050764

§ 371 (c)(1),
(2) Date: Dec. 21, 2018

(87) PCT Pub. No.: WO2017/219145

PCT Pub. Date: Dec. 28, 2017

(65) Prior Publication Data

US 2019/0226143 A1 Jul. 25, 2019

Related U.S. Application Data

(60) Provisional application No. 62/353,504, filed on Jun. 22, 2016.

(51) Int. Cl.
*D21C 9/00* (2006.01)
*D21H 17/33* (2006.01)
(Continued)

(52) U.S. Cl.
CPC ..... *D21C 9/005* (2013.01); *D21H 11/20* (2013.01); *D21H 17/33* (2013.01); *D21H 21/14* (2013.01)

(58) Field of Classification Search
CPC ..... D21H 21/16; D21H 17/37; D21H 11/20; D21H 17/07; D21H 17/33; D21H 17/41;
(Continued)

(56) References Cited

U.S. PATENT DOCUMENTS 3,444,151 A * 5/1969 Gonzalez ..... C08F 257/02 526/203
4,517,751 A 5/1985 Ross et al.
(Continued)

FOREIGN PATENT DOCUMENTS

CN 103 866 624 B 11/2015
JP 2005526148 A 9/2005
(Continued)

*Primary Examiner* — Jose A Fortuna
(74) *Attorney, Agent, or Firm* — Umberg Zipser LLP

(57) ABSTRACT

Cellulosic materials modified with a surface modifier to promote compatibility with a hydrophobic material and methods for producing surface-modified cellulosic materials are provided. The methods include providing a slurry of a cellulosic material and adding a surface modifier to the slurry. The surface modifier may be added to the slurry in a soluble form and precipitated by adjusting the pH. The surface-modified cellulosic material may be solvent-dried and/or dried using conventional drying methods to enhance hydrophobicity. To solvent-dry the surface-modified cellulosic material, a solvent is added to an aqueous slurry of the surface-modified cellulosic material to form an azeotrope. The azeotrope has a boiling point that is less than the boiling point of the solvent. The slurry is distilled to remove the azeotrope from the surface-modified cellulose material. The solvent is removed from the surface-modified cellulose material.

14 Claims, 11 Drawing Sheets

(51) Int. Cl.
*D21H 11/20* (2006.01)
*D21H 21/14* (2006.01)

(58) Field of Classification Search
CPC ..... D21H 17/45; D21H 21/14; D21H 23/04; C08L 25/08; D21C 9/005
See application file for complete search history.

(56) References Cited

U.S. PATENT DOCUMENTS

| | | | | |
|---|---|---|---|---|
| 5,993,604 | A * | 11/1999 | Finlayson | D21H 23/765 162/164.3 |
| 6,482,886 | B1 * | 11/2002 | Finlayson | D06M 15/11 524/562 |
| 6,734,232 | B2 * | 5/2004 | Hagiopol | C08L 25/06 523/223 |
| 6,830,567 | B2 | 12/2004 | Betremieux et al. | |
| 6,830,657 | B1 * | 12/2004 | Betremieux | B01F 17/005 162/158 |
| 6,939,441 | B2 * | 9/2005 | Nurminen | C09C 1/021 106/206.1 |
| 8,133,944 | B2 | 3/2012 | Hidalgo et al. | |
| 8,557,925 | B2 * | 10/2013 | Hagiopol | C08L 23/0869 525/241 |
| 9,700,883 | B2 * | 7/2017 | Klumperman | B01J 41/14 |
| 10,301,777 | B2 * | 5/2019 | Hagiopol | D21H 17/44 |
| 2005/0022956 | A1 * | 2/2005 | Rodriguez | D21H 21/16 162/135 |
| 2008/0214738 | A1 | 9/2008 | Hagiopol et al. | |
| 2010/0200185 | A1 * | 8/2010 | Sakai | D21H 21/16 162/164.6 |
| 2017/0284028 | A1 * | 10/2017 | Hietaniemi | D21H 23/04 |
| 2019/0226143 | A1 * | 7/2019 | Minhas | D21H 11/20 |

FOREIGN PATENT DOCUMENTS

| | | | |
|---|---|---|---|
| JP | 2010031400 | A | 2/2010 |
| JP | 2014125690 | A | 7/2014 |
| RU | 2 164 573 | C1 | 3/2001 |
| WO | 99/45039 | A1 | 9/1999 |
| WO | 2009/009018 | A1 | 1/2009 |
| WO | 2013133093 | A1 | 9/2013 |

* cited by examiner

SURFACE-MODIFIED CELLULOSIC MATERIALS AND METHODS OF PRODUCING THE SAME

REFERENCE TO RELATED APPLICATIONS

This application claims priority from U.S. patent application Ser. No. 62/353,504, entitled SURFACE-MODIFIED CELLULOSIC MATERIALS AND METHODS OF PRODUCING SAME, filed Jun. 22, 2016 which is hereby incorporated herein by this reference in its entirety for all purposes. For purposes of the United States of America this application claims the benefit of U.S. patent application Ser. No. 62/353,504, entitled SURFACE-MODIFIED CELLULOSIC MATERIALS AND METHODS OF PRODUCING SAME, filed Jun. 22, 2016.

TECHNICAL FIELD

This application relates to modified cellulosic materials and methods for producing modified cellulosic materials.

BACKGROUND

It is generally desirable to incorporate cellulosic materials into hydrophobic commodities, including polymers and copolymers such as polypropylene, polyamide, and polyurethane, to reinforce the structural properties of the commodities and/or to replace more expensive and/or more dense materials provided in reinforced hydrophobic commodities. It is also generally desirable to incorporate cellulosic materials into non-polar solvents to modify the flow properties of these solvents. Due to the hydrophilic nature of the surface of cellulosic and lignocellulosic materials, incorporation of these materials into hydrophobic materials is difficult. To promote compatibility, the surface of cellulosic materials may be modified; however, known processes for surface modification, in particular surface hydrophobization (such as esterification, acetylation, acylation, and polymer grafting), involve complex reaction processes (for example, Stanssens, D., et al., "Creating water-repellent and superhydrophobic cellulose substrates by deposition of organic nanoparticles," 2011, *Materials Letters,* 65(12): 1781-1784 and Rastogi, V. K., et al., "Mechanism for Turning the Hydrophobicity of Microfibrillated Cellulose Films by Controlled Thermal Release of Encapsulated Wax," 2014, *Materials,* 7:7196-7216 disclose methods of producing nanoparticles for coating the cellulosic materials), harsh process conditions, multi-step reaction processes, long reaction times, and/or involve drying the cellulosic materials prior to performing the surface modification step(s). Such processes are discussed in Dufresne, A., "Nanocellulose: From Nature to High Performance Tailored Materials," (Berlin, Boston: De Gruyter, 2012).

Further, incorporating modified cellulosic materials into hydrophobic materials often first requires the water within the native cellulosic materials to be removed, which proves to be difficult due to the strong hydrophilic nature of cellulose and the tendency of these materials to aggregate and/or hornificate irreversibly during drying. The aggregation/hornification of cellulose compromises their ability to achieve good dispersion in hydrophobic commodities. To prevent aggregation/hornification, time- and energy-intensive drying processes are commonly used. For example, cellulosic materials may be dried by freeze drying, critical point drying, and/or solvent exchange drying. Solvent exchange drying involves a series of solvent exchange steps whereby cellulosic materials are gradually exchanged from water using a number of progressively less polar solvents. Solvent exchange drying uses large volumes of solvents and produces large volumes of solvent mixtures which must be separated via distillation for recycling. Accordingly, known processes for surface modifying cellulosic materials either produces aggregated materials that do not disperse adequately, or require expensive and time-consuming drying processes to produce a readily-dispersible material.

There is a general desire for a cost-efficient method of modifying the surface of cellulosic materials to promote compatibility with hydrophobic materials, including hydrophobic commodities and non-polar solvents.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the present invention provides a method of producing a surface-modified cellulosic material. The method includes providing a slurry of a cellulosic material and adding a surface modifier to the slurry. The surface modifier interacts with the surface of the cellulosic material.

In some embodiments, adding a surface modifier comprises adding a solution of the surface modifier to the slurry.

In some embodiments, the method includes adjusting the pH of the slurry to precipitate the surface modifier on to the surface of the cellulosic material.

In some embodiments, adjusting the pH of the slurry to precipitate the surface modifier comprises adding a base.

In some embodiments, adding a surface modifier to the slurry comprises adding an amount of the surface modifier that is equal to or in excess of the amount of surface modifier required to coat substantially all of the surface of the cellulosic material.

In some embodiments, the surface modifier comprises a copolymer.

In some embodiments, the surface modifier comprises a modified styrene-co-maleic anhydride (SMA) copolymer.

In some embodiments, the molecular weight of the surface modifier is between about 4,000 g/mol and about 10,000 g/mol. In some embodiments, the molecular weight of the surface modifier is between about 6,000 g/mol and about 7,000 g/mol.

In some embodiments, the styrene:maleic anhydride ratio of the surface modifier is between about 1:1 to about 4:1. In some embodiments, the backbone of the surface modifier is made up of about 40% to about 50% maleic anhydride units and about 50% to about 60% styrene units. In some embodiments, the backbone of the surface modifier is made up of about 42% maleic anhydride units and about 58% styrene units.

In some embodiments, the surface modifier comprises modified maleic anhydride units.

In some embodiments, the maleic anhydride units are at least partially imidized.

In some embodiments, the surface modifier comprises a dimethylaminepropylamine (DMAPA)-imidized SMA copolymer.

In some embodiments, the DMAPA-imidized SMA copolymer is solubilized in water by adding an acetic acid.

In some embodiments, at least 90% of the maleic anhydride units of the SMA copolymer are DMAPA-imidized.

In some embodiments, between about 25% and about 100% of the maleic anhydride units of the SMA copolymer are DMAPA-imidized.

In some embodiments, between about 50% to about 100% of the maleic anhydride units of the SMA copolymer are DMAPA-imidized.

In some embodiments, between about 75% to about 100% of the maleic anhydride units of the SMA copolymer are DMAPA-imdized.

In some embodiments, the DMAPA-imidized SMA copolymer is precipitated from the slurry at a pH of about 8.5.

In some embodiments, the surface modifier comprises an alkali salt form of the modified SMA copolymer.

In some embodiments, the alkali salt form of the modified SMA copolymer is precipitated from the slurry at a pH of less than about 6.

In some embodiments, the modified SMA copolymer is modified with an uncharged and/or less-polar amine.

In some embodiments, the surface modifier comprises an ammonia salt form of the modified SMA copolymer.

In some embodiments, the ammonia salt form of the modified SMA copolymer is precipitated from the slurry at a pH of less than about 8.

In some embodiments, the solids content of the cellulosic material in the slurry is between about 1 wt % and about 50 wt %.

In some embodiments, the method includes controlling a temperature of the slurry to within about 10° C. to about 40° C. before adding the surface modifier.

In some embodiments, the solids content of the surface modifier in the slurry is between about 5 wt % to about 50 wt %.

In some embodiments, the method includes drying a surface-modified cellulosic material.

In some embodiments, drying the surface-modified cellulosic material comprises one or more of the following: filtration, centrifugation, flash drying, co-drying with an unmodified cellulosic material, freeze-drying, spray drying, microwave-assisted drying, vacuum drying, ring drying, fluid bed drying, oven drying, through-air drying, dispersion drying, mixing drying, and solvent drying.

In some embodiments, the method includes one-step solvent drying a surface-modified cellulosic material.

In some embodiments, one-step solvent drying the surface-modified cellulosic material includes providing an aqueous slurry of the surface-modified cellulosic material, adding the aqueous slurry of the surface-modified cellulosic material to a solvent, and distilling the slurry to remove the azeotrope from the surface-modified cellulosic material. The solvent forms an azeotrope having a boiling point that is lower than the boiling point of the solvent.

In some embodiments, the method includes preheating the solvent before adding the aqueous slurry of the surface-modified cellulosic material to the solvent.

In some embodiments, the solvent is preheated to the boiling point of the solvent.

In some embodiments, the solvent is preheated to a temperature between about 80° C. and about 200° C.

In some embodiments, the solvent is preheated to a temperature between about 105° C. to about 150° C.

In some embodiments, the solvent has a boiling point between about 80° C. and about 200° C.

In some embodiments, the solvent has a boiling point between about 105° C. and about 150° C.

In some embodiments, the azeotrope has a boiling point between about 50° C. and about 150° C.

In some embodiments, the azeotrope has a boiling point between about 75° C. and about 100° C.

In some embodiments, the solvent is xylene and the solvent is preheated to a temperature between about 135° C. and about 145° C.

In some embodiments, the solvent is xylene and the solvent is preheated to the boiling point of xylene.

In some embodiments, the solids content of the surface-modified cellulosic material in the aqueous slurry is between about 2 wt % and about 10 wt %.

In some embodiments, the solvent comprises one or more of xylene, toluene, benzene, n-butyl acetate, pyridine, n-propyl acetate, benzyl alcohol, furfuryl alcohol, cyclohexanol, iso-butanol, and n-butanol.

In some embodiments, the method includes removing water from the surface-modified cellulosic material in the form of the azeotrope.

In some embodiments, the method includes condensing the azeotrope to separate the solvent from water.

In some embodiments, the method includes removing the solvent from the surface-modified cellulosic material.

In some embodiments, removing the solvent from the surface-modified cellulosic material comprises one or more of: evaporation, decanting, draining, filtering, and air-drying.

In some embodiments, the method includes adding a compatibilizing agent to one or more of the solvent, the surface-modified cellulosic material after removing the azeotrope, the surface-modified cellulosic material after removing the azeotrope and the solvent.

In some embodiments, the compatibilizing agent comprises one or more of maleic anhydride-grafted polypropylene copolymer and maleic anhydride polypropylene copolymer.

In some embodiments, the surface-modified cellulosic material is more hydrophobic than an unmodified cellulosic material.

In some embodiments, the surface-modified cellulosic material is fibrillated.

In some embodiments, the surface-modified cellulosic material is dispersible.

In some embodiments, the surface-modified cellulosic material is fluffy.

Another aspect of the present invention provides a method of drying a modified cellulosic material. The method includes providing an aqueous slurry of the modified cellulosic material, adding the aqueous slurry of the modified cellulosic material to the solvent, and distilling the slurry to remove the azeotrope from the modified cellulosic material. The solvent forms an azeotrope having a boiling point that is lower than the boiling point of the solvent.

In some embodiments, the method includes preheating the solvent before adding the aqueous slurry of the modified cellulosic material to the solvent.

In some embodiments, the solvent is preheated to the boiling point of the solvent.

In some embodiments, the solvent is preheated to a temperature between about 80° C. and about 200° C.

In some embodiments, the solvent is preheated to a temperature between about 105° C. and about 150° C.

In some embodiments, the solvent has a boiling point between about 80° C. and about 200° C.

In some embodiments, the solvent has a boiling point between about 105° C. and about 150° C.

In some embodiments, the azeotrope has a boiling point between about 50° C. and about 150° C.

In some embodiments, the azeotrope has a boiling point between about 75° C. and about 100° C.

In some embodiments, the solvent is xylene and the solvent is preheated to a temperature between about 135° C. and about 145° C.

In some embodiments, the solvent is xylene and the solvent is preheated to the boiling point of xylene.

In some embodiments, the solids content of the modified cellulosic material in the aqueous slurry is between about 2 wt % and about 10 wt %.

In some embodiments, the solvent comprises one or more of xylene, toluene, benzene, n-butyl acetate, pyridine, n-propyl acetate, benzyl alcohol, furfuryl alcohol, cyclohexanol, iso-butanol, and n-butanol.

In some embodiments, the method includes removing water from the modified cellulosic material in the form of the azeotrope.

In some embodiments, the method includes condensing the azeotrope to separate the solvent from water.

In some embodiments, the method includes removing the solvent from the modified cellulosic material.

In some embodiments, removing the solvent from the modified cellulosic material comprises one or more of: evaporation, decanting, draining, filtering, dispersion drying, mixing drying, and air-drying.

In some embodiments, the method includes adding a compatibilizing agent to one or more of the solvent, the modified cellulosic material after removing the azeotrope, the modified cellulosic material after removing the azeotrope and the solvent.

In some embodiments, the compatibilizing agent comprises one or more of maleic anhydride-grafted polypropylene copolymer and maleic anhydride polypropylene copolymer.

In some embodiments, the modified cellulosic material is hydrophobic.

In some embodiments, the modified cellulosic material comprises one or more of an alkenyl succinic anhydride-modified cellulosic material and a silylated cellulosic material.

Another aspect of the present invention provides a surface-modified cellulosic material produced according to a method of producing a surface-modified cellulosic material. The method includes providing a slurry of a cellulosic material and adding a surface modifier to the slurry. The surface modifier interacts with the surface of the cellulosic material.

In some embodiments, the surface-modified cellulosic material has a contact angle of at least about 80°.

In some embodiments, the surface-modified cellulosic material has a contact angle of at least about 100°.

In some embodiments, the surface-modified cellulosic material has a contact angle of at least about 110°.

In some embodiments, the surface-modified cellulosic material has a contact angle of at least about 125°.

In some embodiments, the solids content of a surface modifier is less than about 10 wt %.

In some embodiments, the solids content of a surface modifier is between about 1 wt % and about 5 wt %.

In some embodiments, the solids content of a surface modifier is about 2 wt %.

In some embodiments, the water content is less than about 5 wt %.

In some embodiments, the surface-modified cellulosic material is more hydrophobic than an unmodified cellulosic material.

In some embodiments, the surface-modified cellulosic material is fibrillated.

In some embodiments, the surface-modified cellulosic material is dispersible.

In some embodiments, the surface-modified cellulosic material is fluffy.

Another aspect of the present invention provides a modified cellulosic material produced according to a method of drying a modified cellulosic material. The method includes providing an aqueous slurry of the modified cellulosic material, adding the aqueous slurry of the modified cellulosic material to the solvent, and distilling the slurry to remove the azeotrope from the modified cellulosic material. The solvent forms an azeotrope having a boiling point that is lower than the boiling point of the solvent.

In some embodiments, the modified cellulosic material has a contact angle of at least about 85°.

In some embodiments, the modified cellulosic material has a contact angle of at least about 100°.

In some embodiments, the modified cellulosic material has a contact angle of at least about 110°.

In some embodiments, the modified cellulosic material has a contact angle of at least about 125°.

In some embodiments, the solids content of a surface modifier is less than about 10 wt %.

In some embodiments, the solids content of a surface modifier is between about 1 wt % and about 5 wt %.

In some embodiments, the solids content of a surface modifier is about 2 wt %.

In some embodiments, the water content is less than about 5 wt %.

In some embodiments, the surface-modified cellulosic material is more hydrophobic than an unmodified cellulosic material.

In some embodiments, the surface-modified cellulosic material is fibrillated.

In some embodiments, the surface-modified cellulosic material is dispersible.

In some embodiments, the surface-modified cellulosic material is fluffy.

Another aspect of the present invention provides a use of a surface-modified cellulosic material for modifying the flow properties of a non-polar solvent.

Another aspect of the present invention provides a use of a surface-modified cellulosic material for modifying the structural properties of a hydrophobic commodity.

Another aspect of the present invention provides a use of a modified cellulosic material for modifying the flow properties of a non-polar solvent.

Another aspect of the present invention provides a use of a modified cellulosic material for modifying the structural properties of a hydrophobic commodity.

Another aspect of the present invention provides a hydrophobic material comprising a surface-modified cellulosic material.

Another aspect of the present invention provides a non-polar solvent comprising a surface-modified cellulosic material.

Another aspect of the present invention provides a hydrophobic material comprising a modified cellulosic material.

Another aspect of the present invention provides a non-polar solvent comprising a modified cellulosic material.

Another aspect of the present invention provides a method of producing a reinforced hydrophobic material. The method includes producing a surface-modified cellulosic material and adding the surface-modified cellulosic material to a hydrophobic material.

In some embodiments, the method includes separating the surface-modified cellulosic material from a slurry.

In some embodiments, the surface-modified cellulosic material is added to the hydrophobic material via one or more of the following: compounding, mixing, and blending.

Another aspect of the present invention provides a method of producing a reinforced hydrophobic material. The method includes drying a modified cellulosic material and adding the modified cellulosic material to a hydrophobic material.

In some embodiments, the modified cellulosic material is added to the hydrophobic material via one or more of the following: compounding, mixing, and blending.

Another aspect of the present invention provides a method of producing a rheology-modified non-polar solvent. The method includes producing a surface-modified cellulosic material, separating the surface-modified cellulosic material from a slurry, and adding the surface-modified cellulosic material to a non-polar solvent.

Another aspect of the present invention provides a method of producing a rheology-modified non-polar solvent. The method includes drying a modified cellulosic material and adding the modified cellulosic material to a non-polar solvent.

Another aspect of the present invention provides a hydrophobic cellulosic material comprising a cellulosic material surface-modified with a surface modifier.

In some embodiments, the surface modifier comprises a copolymer.

In some embodiments, the surface modifier comprises a modified SMA copolymer.

In some embodiments, the molecular weight of the surface modifier is between about 4,000 g/mol and about 10,000 g/mol. In some embodiments, the molecular weight of the surface modifier is between about 6,000 g/mol and about 7,000 g/mol.

In some embodiments, the styrene:maleic anhydride ratio of the surface modifier is between about 1:1 to about 4:1.

In some embodiments, the In some embodiments, the backbone of the surface modifier is made up of about 40% to about 50% maleic anhydride units and about 50% to about 60% styrene units. In some embodiments, the backbone of the surface modifier is made up of about 42% maleic anhydride units and about 58% styrene units.

In some embodiments, the surface modifier comprises modified maleic anhydride units.

In some embodiments, the maleic anhydride units are at least partially imidized.

In some embodiments, the surface modifier comprises a DMAPA-imidized SMA copolymer.

In some embodiments, the DMAPA-imidized SMA copolymer is solubilized in water by adding an acetic acid.

In some embodiments, at least 90% of the maleic anhydride units of the SMA copolymer are DMAPA-imidized. In some embodiments, between about 25% and about 100% of the maleic anhydride units of the SMA copolymer are DMAPA-imidized. In some embodiments, between about 50% and about 100% of the maleic anhydride units of the SMA copolymer are DMAPA-imidized. In some embodiments, between about 75% and about 100% of the maleic anhydride units of the SMA copolymer are DMAPA-imidized.

In some embodiments, the DMAPA-imidized SMA copolymer is precipitated from the slurry at a pH of about 8.5.

In some embodiments, the surface modifier comprises an alkali salt form of the modified SMA copolymer.

In some embodiments, the modified SMA copolymer is modified with an uncharged and/or less-polar amine.

In some embodiments, the surface modifier comprises an ammonia salt form of the modified SMA copolymer.

In some embodiments, the hydrophobic cellulosic material includes a compatibilizing agent.

In some embodiments, the compatibilizing agent comprises one or more of maleic anhydride-grafted polypropylene copolymer and maleic anhydride polypropylene copolymer.

In some embodiments, the hydrophobic cellulosic material has a contact angle of at least about 80°.

In some embodiments, the hydrophobic cellulosic material has a contact angle of at least about 100°.

In some embodiments, the hydrophobic cellulosic material has a contact angle of at least about 110°.

In some embodiments, the hydrophobic cellulosic material has a contact angle of at least about 125°.

In some embodiments, the solids content of a surface modifier is less than about 10 wt %.

In some embodiments, the solids content of a surface modifier is between about 1 wt % and about 10 wt %.

In some embodiments, the solids content of a surface modifier is about 2 wt %.

In some embodiments, the water content is less than about 5 wt %.

In some embodiments, the hydrophobic cellulosic material is more hydrophobic than an unmodified cellulosic material.

In some embodiments, the surface-modified cellulosic material is fibrillated.

In some embodiments, the surface-modified cellulosic material is dispersible.

In some embodiments, the surface-modified cellulosic material is fluffy.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Figure 1:
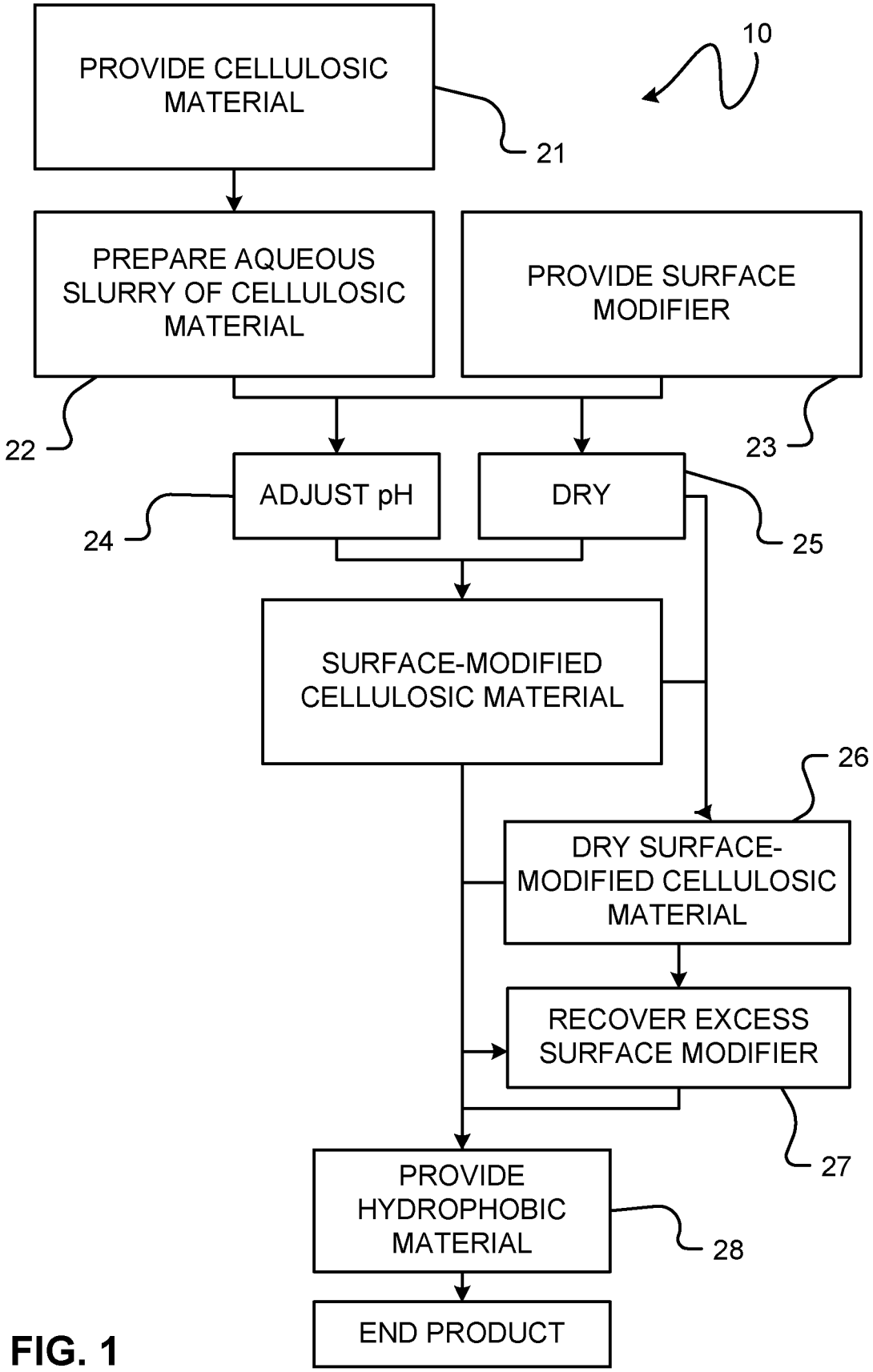
FIG. 1 is a flow chart which illustrates methods for making a surface-modified cellulosic material according to some embodiments of the present invention.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Unless context dictates otherwise, "cellulosic material" (as used herein) includes, but is not limited to, one or more of a cellulosic, hemicellulosic, and lignocellulosic fibrils and/or fibers including, but not limited to pulp fibers, kraft fibers, and thermomechanical pulp (TMP) derived from one or more of hardwood, softwood, agricultural material (such as residues from agricultural crops including, but not limited to, one or more of wheat straw, barley straw, and corn stalks and fibrous materials including, but not limited to, cotton, hemp, flax, jute, and sisal), algal cellulose, marine plant cellulose, and derivatives thereof including, but not limited to, one or more of pulp fibers (including, but not limited to, one or more of mechanical, thermomechanical, chemi-thermomechanical, chemical, recycled, and organosolv pulp), nanofibrillated cellulose (also known as cellulose nanofibrils), microfibrillated cellulose, fibrillated cellulose, and microcrystalline cellulose. In some embodiments, cellulosic materials exclude bacterial cellulose and nanocrystalline cellulose (also known as cellulose nanocrystals). In certain embodiments, cellulosic materials are in a form wherein fibrils are loose and individual. In such embodiments the cellulosic material is dispersible, fibrillated, and not aggregated/hornificated/bonded together. The surface of cellulosic material is largely hydrophilic. Cellulosic materials may be used in the production of paper products including, but not limited to, paper cups.

Unless context dictates otherwise, "contact angle" (as used herein) refers to the angle where a liquid-vapour interface meets a solid surface. The angle is measured through the liquid (such as water). Contact angle ($\theta_C$) quantifies the wettability of a solid surface by a liquid via the Young equation: $\gamma_{SG}-\gamma_{SL}-\gamma_{LG}\cos\theta_C=0$, where $\gamma_{SG}$ is the surface tension at the solid-gas interface, $\gamma_{SL}$ is the surface tension at the solid-liquid interface, and $\gamma_{LG}$ is the surface tension at the liquid-gas interface.

Unless context dictates otherwise, "wettability" (as used herein) refers to the ability of a liquid to maintain contact with a solid surface, resulting from interactions between the liquid and solid surface when brought together.

Unless context dictates otherwise, "hydrophobic material" (as used herein) includes a hydrophobic commodity, a non-polar solvent, and/or a low-polarity solvent.

Unless context dictates otherwise, "commodity" (as used herein) refers to an input used in the production of other products. For example, a commodity may include a raw material. A commodity may additionally or alternatively include a polymer and/or a copolymer, such as one or more of polypropylene, polyamide, polyurethane, polylactic acid, high-density polyethylene, and low-density polyethylene.

Unless context dictates otherwise, "raw materials" (as used herein) refers to crude or unprocessed materials or substances used in the primary production or manufacture of goods. Raw materials are often natural resources, such as oil, iron, and wood.

Unless context dictates otherwise, "hydrophobic" (as used herein) refers to a capacity to repel or fail to mix with water.

Unless context dictates otherwise, "non-polar" (as used herein) refers to a molecule or molecules lacking a significant dipole moment.

Unless context dictates otherwise, "polymer" (as used herein) refers to a large molecule, or macromolecule, formed by the polymerization of many smaller molecules, called monomers, in a form that often, but not always, consists of a repeating structure.

Unless context dictates otherwise, "copolymer" (as used herein) refers to a polymer that is derived from two or more different monomers.

Unless context dictates otherwise, "weight percent" (wt %) (as used herein) refers to the ratio of the mass of one substance ($m_1$) to the mass of a total mixture ($m_{tot}$), as defined as:

$$\text{Weight percent} = \frac{m1}{m_{tot}} \times 100\%$$

Unless context dictates otherwise, "azeotrope" (as used herein) refers to a mixture of two liquids that has a constant boiling point and composition throughout distillation.

Unless context dictates otherwise, "slurry" (as used herein) refers to a semi-liquid mixture. The mixture may be colloidal.

Unless context dictates otherwise, "dispersal aid" and "drying aid" (as used herein) refer to physical and/or chemical compounds that prevent aggregation and promote the separation of one or more of fibres, fibrils, and nanoparticles during drying.

Unless context dictates otherwise, "cellulose fibril" (as used herein) refers to a bulk fibrillated cellulose material.

Unless context dictates otherwise, "fibrillated cellulose" (as used herein) refers to a cellulose fiber that has been refined or fibrillated using other methods conventionally known to convert more than about 25% of the mass of the fiber into nanoscale and/or microscale fibrillated regions. Unless context dictates otherwise, "fibrillated" (as used herein) refers to a method of refining a cellulose fiber to convert more than about 25% of the mass of the fiber into nanoscale and/or microscale fibrillated regions.

Unless context dictates otherwise, "about" (as used herein) means near the stated value (i.e. within ±5% of the stated value, within ±1 pH unit of the stated pH value, within ±10° of the stated contact angle as context dictates, or within 30 minutes of the stated time value).

Some embodiments of the present invention provide surface-modified cellulosic materials and methods for surface-modifying cellulosic materials to enhance the compatibility of the cellulosic material with a hydrophobic material. The methods include providing a slurry of a cellulosic material and adding a surface modifier to the slurry. The surface modifier may be added to the slurry in a soluble form and precipitated by adjusting the pH. The precipitated surface modifier may react with the cellulosic material in solution and/or during drying. The surface-modified cellulosic material may be dried (i.e. water may be removed from the surface-modified cellulosic material) according to methods conventionally known (including, but not limited to, one or more of ring drying, flash drying, dispersion drying, fluid bed drying, oven drying, through-air drying, spray drying, solvent drying, etc.) and/or may be solvent-dried according to an example embodiment of the present invention. The dried surface-modified cellulosic material has a high compatibility with hydrophobic materials and exhibits minimal aggregation and/or hornification on drying.

Some embodiments of the present invention provide methods to solvent-dry surface-modified cellulosic materials. An aqueous slurry of the surface-modified cellulosic material is provided. A solvent is added to the slurry to form an azeotrope having a boiling point that is lower than the boiling point of the solvent. The slurry is distilled to remove the azeotrope from the surface-modified cellulose material. The solvent-dried surface-modified cellulosic material has a high compatibility with hydrophobic materials and exhibits minimal aggregation and/or hornification on drying. A compatibilizing agent may be added to the slurry during solvent-drying and/or following azeotrope distillation to enhance the hydrophobic properties of the surface-modified cellulosic material.

The surface-modified cellulosic materials according to some embodiments of the present invention are dispersible, fibrillated, and not initially aggregated/hornificated/bonded together. The surface-modified cellulosic materials comprise fibrils, the surface of which is at least partially coated with a surface modifier.

FIG. 1 shows a method 10 of producing a surface-modified cellulosic material according to an example embodiment. The method involves providing a slurry in which both a surface modifier and particles of a cellulosic material are present. The order in which the cellulosic material and surface modifier are introduced to a liquid may be varied. In the example method 10 cellulosic material is added to a liquid to form a slurry and the surface modifier is then added to the slurry. In block 21 a cellulosic material is provided. The cellulosic material may be provided as one or more of bales, sheets, dried sheets, and a mixture in a liquid (such as water) or a slurry having a solids content between about 1 wt % to about 50 wt %. In block 22 a homogeneous slurry of the cellulosic material is prepared by adding a liquid, such as water, to the cellulosic material and mixing with a blender, disintegrator, repulper, refiner, or other mixing means conventionally known to wet the cellulosic material. In some embodiments, an additive including, but not limited to, one or more of a buffering agent, a salt, a solvent, and a dispersal or drying aid (including, but not limited to, one or more of clay minerals, polymer fibers, and polymer powders) is added to the slurry in block 22.

The solids content of cellulosic material in the slurry may be less than about 0.1 wt %, more preferably in the range of about 1 wt % to about 50 wt %. The solids content of the slurry may be limited by the equipment available to mix the cellulosic material into the liquid and/or the specific cellulosic material. In some embodiments, the pH of the slurry is between about 4 to about 7. The pH of the slurry may be adjusted to cause a desired amount of precipitation of a surface modifier having pH-dependent solubility that is to be added to the slurry, as described elsewhere herein.

In block 23 the surface modifier is provided. The surface modifier is added to the slurry. The surface modifier may be added as a solution at ambient temperature and pressure. In some embodiments, the slurry is brought to a temperature in the range of about 10° C. to about 45° C., preferably in the range of about 20° C. to about 45° C., before the surface modifier is added thereto. The slurry is mixed until the surface modifier is uniformly dispersed in the mixture. In some embodiments, the ratio of the weight of surface modifier in the slurry to the dry weight of cellulosic material in the slurry is in the range of 1:20 to 1:1. In some embodiments the weight of surface modifier in the slurry to the dry weight of cellulosic material in the slurry is in the range of 1:10 to 1:2.

The surface modifier comprises a copolymer. In some embodiments, the copolymer is water soluble. Solubility of the surface modifier in water may be adjusted by changing the pH and/or the temperature of the slurry. The surface modifier associates with a cellulosic material through one or more of covalent attachment, electrostatic interactions, and non-specific Van der Waals interactions. A cellulosic material modified with the surface modifier displays enhanced hydrophobicity either directly through the hydrophobic features of the surface modifier and/or through the hydrophobic features of the surface modifier under certain conditions (for example, when the surface modifier undergoes a chemical reaction, rendering it more hydrophobic). The surface of the cellulosic material is at least partially coated with the surface modifier.

The surface modifier includes hydrophobic groups that interface well with hydrophobic commodity materials. The hydrophobic groups may be inherent and/or formed during precipitation and/or drying. In some embodiments, the hydrophobic groups are formed during precipitation and/or drying.

In some embodiments, the surface modifier comprises a modified styrene-co-maleic anhydride (SMA) copolymer. The modified SMA copolymer may, for example, have the following general formula for the backbone of the copolymer:

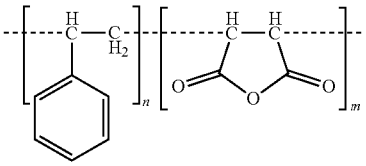

In some embodiments, the molecular weight of the modified SMA copolymer is in the range of about 4,000 g/mol to about 10,000 g/mol. In some embodiments, the styrene/maleic anhydride ratio of the surface modifier may be between about 1:1 to about 4:1. In some embodiments, the SMA copolymer is modified by a reaction with one or more of alkali materials, amines, and cationic salts and/or via cationic imidization.

To enhance the solubility of the surface modifier in aqueous solvents the surface modifier may be solubilized in various ways. For example, for a SMA copolymer, maleic anhydride units in the surface modifier may be modified. For example, in some embodiments, up to about 100% of the anhydride groups of the modified SMA copolymer are imidized. The percent of anhydride groups that are imidized may be optimized to enhance reactions between the anhydride groups of the modified SMA copolymer and a cellulosic material while promoting solubility of the modified SMA copolymer in an aqueous solvent. In some embodiments, the modified SMA copolymer comprises a partially or fully imidized SMA copolymer. For example, the SMA copolymer may be partially or fully imidized using dimethylpropylamine (DMAPA), then solubilized using acetic acid.

In some embodiments, the SMA copolymer is partially imidized by combining an SMA copolymer and DMAPA in a non-reacting diluent. The resulting mixture is heated within the range of about 150° C. to about 180° C. for a period of about 2 to about 3 hours. Water is removed during the heating period. The tertiary amine of the resulting DMAPA-imidized SMA copolymer is then protonated via acidification, for example by adding an acid including, but not limited to hydrochloric acid and acetic acid. The resulting cationic DMAPA-imidized SMA copolymer is water-soluble. When dissolved in water, a cationic aqueous solution is produced. Solubilization of DMAPA-imidized SMA by acetic acid is shown by the reaction mechanism below:

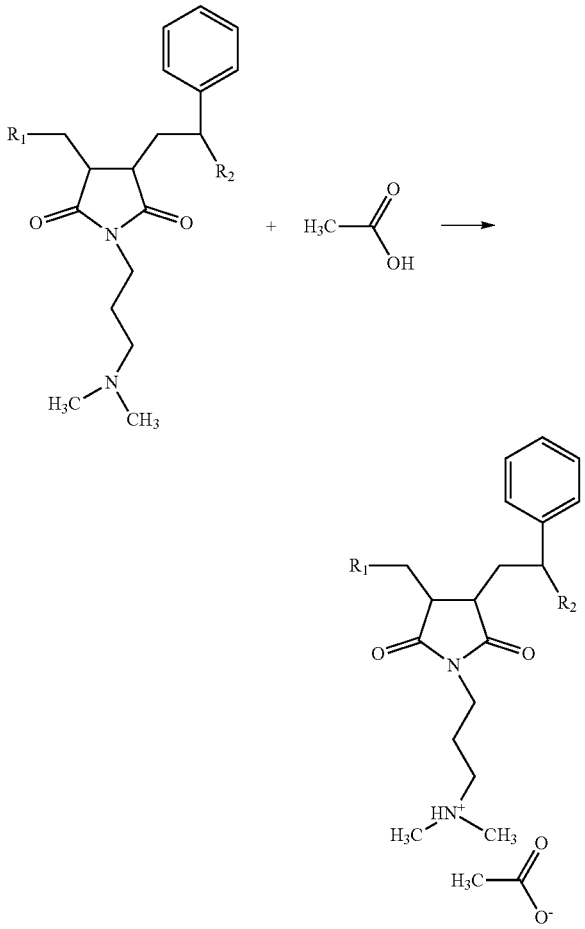

In some embodiments, the unmodified SMA copolymer has a molecular weight (MW) of about 5,000 g/mol and the DMAPA-imidized SMA copolymer has a MW in the range of about 6,500 g/mol to about 7,000 g/mol. In some embodiments, the unmodified SMA copolymer has a backbone made up of about 40% to about 50% maleic anhydride units and about 50% to about 60% styrene units. In some embodiments, the unmodified SMA copolymer has a backbone made up of about 42% maleic anhydride units and about 58% styrene units. In some embodiments, greater than about 90% of the maleic anhydride units of the SMA copolymer are DMAPA-imidized. In some embodiments, between about 25% to about 100% of the maleic anhydride units of the SMA copolymer are DMAPA-imidized. In some embodiments, between about 50% to about 100% of the maleic anhydride units of the SMA copolymer are DMAPA-imidized. In some embodiments, between about 75% to about 100% of the maleic anhydride units of the SMA copolymer are DMAPA-imidized. In some embodiments, the glass transition temperature (Tg) of the DMAPA-imidized SMA copolymer is in the range of about 75° C. to about 90° C.

DMAPA-imidized SMA copolymers are commercially available. DMAPA-imidized SMA copolymers can be precipitated from aqueous solution by neutralizing the charge of the copolymer's tertiary amine. This can be achieved by adjusting the pH to a value within the range of about 7.5 to about 10. DMAPA-imidized SMA copolymers are available to associate with a cellulosic material via ionic and/or Van der Waals forces. DMAPA-imidized SMA copolymers may covalently bind to the cellulosic material through an esterification reaction between residual (i.e. non-imidized) copolymer maleic anhydride groups and cellulosic material hydroxyl groups. Esterification may be carried out during or after drying the surface-modified cellulosic material. Esterification may be enhanced by adding an anhydride-stabilizing or esterification-promoting catalyst such as sodium hypophosphite (see, for example, Yang, C. Q., et al., "Cross-Linking Cotton Cellulose by the Combination of Maleic Acid and Sodium Hypophosphite," 2010 *Industrial & Engineering Chemistry Research,* 49(18): 8325-8332). The surface-modified cellulosic materials may be dried (i.e. water may be removed from the surface-modified cellulosic materials) as described elsewhere herein.

In some embodiments, the SMA copolymer may be modified to form a water-soluble anionic alkali salt. This may be performed by reacting the SMA copolymer with an alkaline material, such as sodium hydroxide and/or potassium hydroxide at a temperature in the range of about 10° C. to about 90° C. Preferably, the SMA copolymer is reacted with the alkaline material at a temperature in the range of about 60° C. to about 90° C. for a reaction period of about 1 hour to about 5 hours. The pH may be adjusted to an alkali pH of about 10 to maintain the aqueous solubility of the alkali salt form of the SMA copolymer. The alkali salt form of the SMA copolymer may be precipitated onto a cellulosic material by acidifying the cellulosic material/modified SMA copolymer solution below a pH of about 6 using an acid including, but not limited to, acetic acid and/or hydrochloric acid. Alkali salt forms of SMA copolymers are available to associate with a cellulosic material via ionic interactions and/or Van der Waals forces. Alkali salt forms of SMA copolymers may covalently bind to the cellulosic material through an esterification reaction between residual (i.e. non-imidized) copolymer maleic anhydride groups and cellulosic material hydroxyl groups, as described elsewhere herein.

In some embodiments, the amic acid form of the copolymer is used to promote ring-closing and formation of an imide with the cellulosic material. The amic acid forms may be produced using any amine that would render the SMA copolymer soluble in water (see, for example, U.S. Pat. No. 6,232,405). The solution of the cellulosic material and the amic acid form of the modified SMA copolymer is dried at temperatures greater than about 100° C. to dehydrate the amic acid. Dehydration of the amic acid causes ring closure and formation of an imide form of the SMA copolymer maleic group (i.e. a maleimide is formed). Ring closure converts the SMA copolymer from a hydrophilic form (i.e. the amic acid) to a more hydrophobic imide form. Unlike with the DMAPA-imidized SMA copolymer, SMA copolymers modified with uncharged and/or less-polar amines, such as methylamine or monoethanolamine, are not soluble in water at any pH once ring closure/imidization has occurred. As such, the amic acid form remains soluble (i.e. is not precipitated) until the amic acid is dehydrated. Dehydration results in the hydrophobization of the modified SMA copolymer via ring-closure. In this way, surface modification of a cellulosic material may also be achieved during drying. In some embodiments, dehydrating the amic acid simultaneously crosslinks the modified SMA copolymer to the hydroxyl groups of the cellulosic material (see, for example, Johnson, E. H. and Cuculo, J. A., "The Reaction of Cellulose with Amic Acids and Anhydride/Ammonia, Part III: Reactivity of Alpha, Beta-Amic Acids and Corresponding Anhydrides/Ammonia," 1973, *Textile Research Journal,* 43(5): 283-293). The surface-modified cellulosic materials may then be dried (i.e. water may be removed from the surface-modified cellulosic materials) as described elsewhere herein.

In some embodiments, the SMA copolymer may be modified by converting the copolymer to an ammonia salt form by reacting the SMA copolymer with ammonia. This reaction forms a primary amide and a carboxylic acid in place of the anhydride group on the maleic anhydride unit, similar to the reaction between an SMA copolymer and an amine as described elsewhere herein except that the ammonia salt lacks the R-group of the amine. The ammonia salt form of the SMA copolymer is soluble at a pH of greater than about 8. To surface modify a cellulosic material with an ammonia salt form of a SMA copolymer, the pH of a solution of the cellulosic material is first adjusted to above about 8. The solubilized modified SMA copolymer is then added to the cellulosic material and the pH is lowered below about 8 to induce precipitation of the modified SMA copolymer onto the surface of the cellulosic material. Ammonia salt forms of SMA copolymers may covalently bind to the cellulosic material through an esterification reaction between residual (i.e. non-imidized) copolymer maleic anhydride groups and cellulosic material hydroxyl groups, as described elsewhere herein. Alternatively, the cellulosic material may be surface modified with the ammonia salt form of the SMA copolymer by heating and drying an aqueous mixture of the modified SMA copolymer and cellulosic material (i.e. without first precipitating the modified SMA copolymer).

In some embodiments, drying causes dehydration and ring closure of the modified maleic groups to form a hydrophobic maleimide, similar to dehydration of an amic acid form of a SMA copolymer described elsewhere herein. Dehydration/ring closure also promotes a covalent reaction between the amic acid and cellulosic material hydroxyl groups (see, for example, Johnson, E. H. and Cuculo, J. A., "The Reaction of Cellulose with Amic Acids and Anhydride/Ammonia, Part III: Reactivity of Alpha, Beta-Amic Acids and Corresponding Anhydrides/Ammonia," 1973, *Textile Research Journal,* 43(5): 283-293). In some embodiments, the maleic anhydride units present on the copolymer may hydrolyze in water to produce the dicarboxylic acid form. A ring-closing reaction to reform the anhydride group can occur during drying, and can be promoted through addition of an anhydride-stabilizing or esterification-promoting catalyst such as sodium hypophosphite, as described above. This re-formed anhydride is then available to react with hydroxyl groups on the cellulose surface.

The SMA copolymer modifications described elsewhere herein, which are designed to solubilize the SMA copolymer in aqueous solution, may be used with SMA copolymers that have been partially esterified using a wide range of esterifying alcohols. Esterified SMA copolymers contain a combination of anhydride and mono-ester/mono-carboxylic acid functionalities. The composition of esterified SMA copolymers varies with the starting SMA copolymer used, the structure of the esterifying alcohol, and the extent of esterification.

In optional block 24 (FIG. 1) the pH of the slurry is adjusted to precipitate the surface modifier and modify the surface of the cellulosic material with the precipitated surface modifier. The pH at which the surface modifier precipitates depends on the type of surface modifier, as described elsewhere herein. For example, DMAPA-imidized SMA copolymers may precipitate at a pH in the range of about 7.5 to about 10. Alkali salt forms of SMA copolymers may precipitate at a pH less than about 6. Ammonia salt forms of SMA copolymers may precipitate at a pH less than about 8. In some embodiments, precipitation is reversible and the surface modifier may be re-solubilized by adjusting the pH. Without being bound by theory, it is speculated that when precipitated, the surface modifier interacts with the surface of the cellulosic material through one or more of Van der Waals forces, hydrogen bonding, and esterification between the anhydride groups of the surface modifier and the hydroxyl groups of the cellulosic material. In some embodiments, covalent interaction between the surface modifier and the surface of the cellulosic material may be promoted through drying. The reaction between a maleic anhydride group of a surface modifier and a hydroxyl group on the surface of a cellulosic material may, for example, be depicted by the following reaction mechanism:

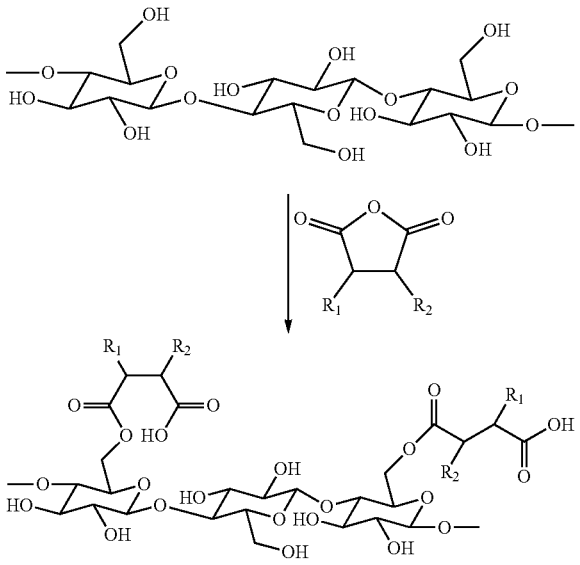

wherein $R_1$ and/or $R_2$ is a chain of covalently bonded monomers. In the reaction mechanism depicted directly above, the maleic anhydride group of the copolymer surface modifier reacts with the hydroxyl group of the cellulosic material to form an ester bond and covalently modify the surface of the cellulosic material. The cis (left) and trans (right) configuration of the surface-modified cellulosic material are shown.

Alternatively, in optional block 25 the solution of cellulosic material and surface modifier may be dried without first adjusting the pH to modify the surface of the cellulosic material with the surface modifier, as described elsewhere herein. However, solubilizing the surface modifier prior to combining it with the aqueous slurry of cellulosic material and adjusting the pH of the combined slurry to precipitate the surface modifier may promote the compatibility of method 10 with upstream processing steps for producing a cellulosic material. For example, solubilizing the surface modifier prior to combining it with the aqueous slurry of cellulosic material and adjusting the pH of the slurry to precipitate the surface modifier enhances the compatibility of the surface-modified cellulosic materials with the solvent-drying methods according to example embodiments of the present invention described elsewhere herein. Persons skilled in the art will recognize that the solubilized surface modifier may be precipitated onto the surface of the cellulosic material within a pulping facility at any point where the cellulosic material is available as an aqueous slurry. For example, the solubilized surface modifier may be precipitated onto the surface of the cellulosic material during fiber processing, during the refining process in the production of fibrillated cellulose, and/or during other processing/refining stages within a pulping facility.

Figure 2:
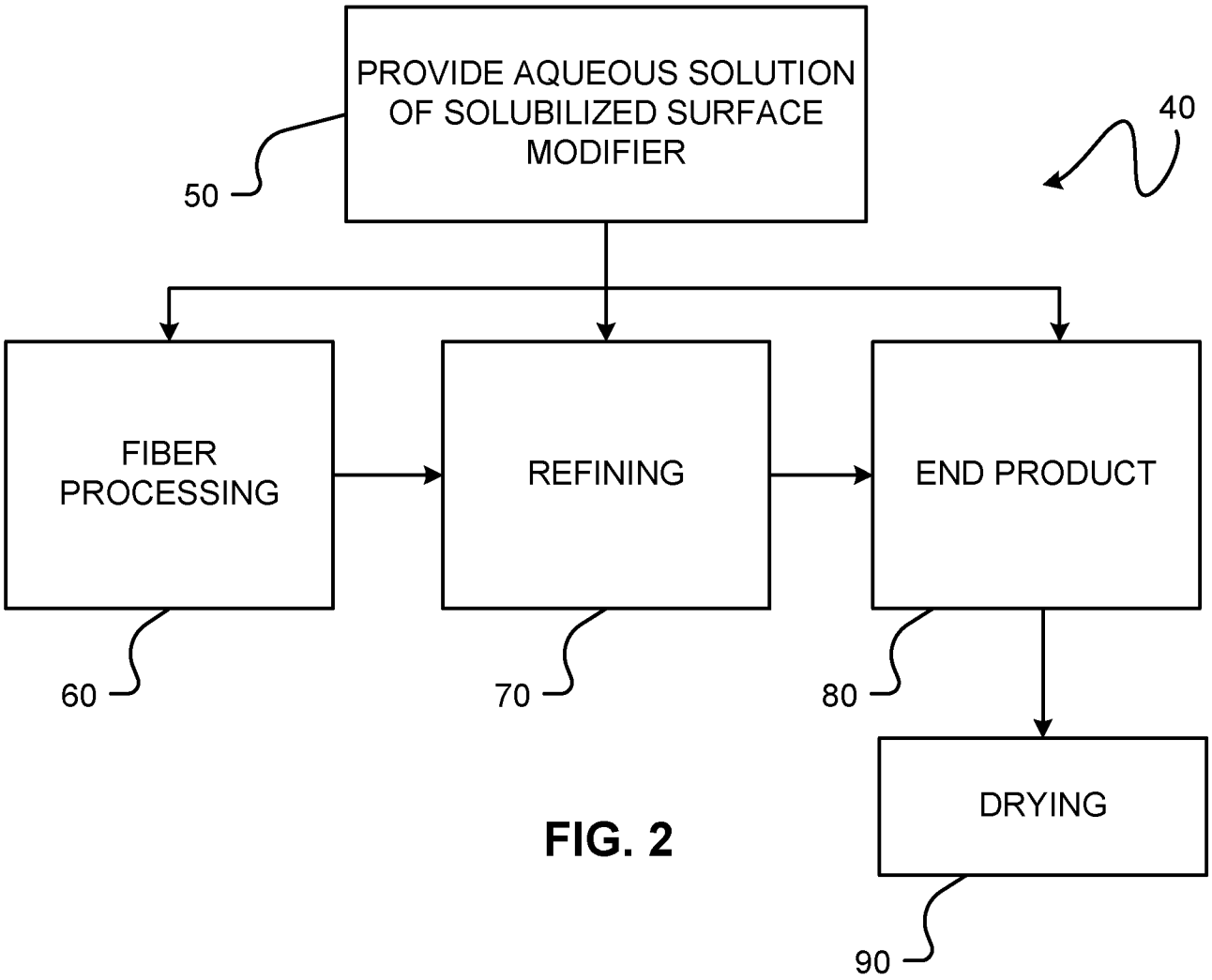
FIG. 2 is a schematic illustration of a pulping facility according to an example embodiment of the present invention.

FIG. 2 shows a pulping facility 40. In block 50 a surface modifier solubilized in an aqueous solution is provided. The aqueous solution of solubilized surface modifier may be added to one or more of block 60, block 70, block 80, and other processing/refining stages within pulping facility 40 (not shown) to immobilize the surface modifier on the surface of a cellulosic material undergoing processing. In block 60, the cellulosic material undergoes fiber processing. In block 70, the cellulosic material undergoes refining. In block 90, the cellulosic material is dried. In some embodiments, the pH of the solution is adjusted in one or more of blocks 60 and 70.

In some embodiments, an amount of surface modifier that exceeds the amount needed to fully coat the surface of the cellulosic material may be added to the aqueous slurry. Following precipitation of the surface modifier and extraction of the surface-modified cellulosic material, the excess surface modifier may be recovered from solution and/or the solvent may be recycled. In optional block 27 (FIG. 1) the excess surface modifier is recovered. An advantage of providing an excess amount of surface modifier may be to maximize surface coverage of the cellulosic material with the surface modifier. An advantage of removing excess surface modifier may be to increase the amount of surface-modified cellulosic material that may be solvent-dried (as described elsewhere herein) per volume of solvent.

Modifying the surface of a cellulosic material with the surface modifier as described herein increases the hydrophobicity of the cellulosic material. For example, the contact angle of an unmodified cellulosic material is within a range of about 10° to about 60° depending on the constitution of cellulosic material and/or the lignin content of the cellulosic material. Typically, the contact angle of an unmodified cellulosic material is about 25°. In contrast, the contact angle of at least one face of a handsheet generated from the surface-modification of a cellulosic material according to certain embodiments of the present invention is at least about 75°. In some embodiments, the contact angle of the surface-modified cellulosic material is between about 75° and about 110°. The contact angle of the surface-modified cellulosic material may be greater than 100°. Contact angles that are greater than those of unmodified cellulosic materials may be achieved even at low surface modifier weight percent (wt %) loadings (i.e. the ratio of the mass of the surface modifier to the mass of the cellulosic material. For example, a cellulosic material surface-modified with less than about 10 wt % of the surface modifier may have a contact angle of at least about 85°. Contact angles may be determined by conditioning dried surface-modified cellulosic material handsheets in a 50% controlled humidity room at about 20° C. for about 24 hours. Contact angle is best measured using the handsheet form of the surface-modified cellulosic material. Handsheets may be generated from a wet slurry of surface-modified cellulosic material as conventionally known.

The characteristics of the surface-modified cellulose material may depend on the process used to dry the material. After surface modification, the cellulose is typically in a low-consistency slurry form (i.e. between about 2 wt % to about 4 wt % modified cellulose in water). The surface-modified cellulosic material may exist in a higher-consistency slurry form (for example, greater than about 30 wt % modified cellulose in water). The slurry can be dried in a number of different ways conventionally known that result in different forms with different moisture contents. For example, if the surface-modified cellulosic material is solvent dried, the dried material is very fluffy with less than about 5 wt % water. If the surface-modified cellulosic material is dried in a sheet (such as with paper making), the material is in a paper-like sheet form, is not fluffy, and typically has a moisture content between about 5 wt % to about 20 wt %. If freeze-dried, the surface-modified cellulosic material will be low density, in a lightweight 'aerogel' form having less than about 5 wt % water. If dried in a ring/flash dryer, the material is somewhat fluffy (particularly if co-dried with a carrier pulp or other material that prevents the material from aggregating during drying). The surface modifier may be present in a range of about 1 wt % to about 10 wt % of the surface-modified cellulosic material. In the case of solvent drying, the surface modifier may be present in a range of about 0.05 wt % to about 10 wt % of the surface-modified cellulosic material.

Compared to an unmodified cellulosic material, the surface-modified cellulosic material of the present invention displays enhanced compatibility with hydrophobic materials. Accordingly, the surface-modified cellulosic material of the present invention may be incorporated into a non-polar solvent to modify the flow properties of the solvent and/or into a hydrophobic commodity to enhance the structural properties of the commodity and/or replace or supplement other more expensive and/or denser materials. For example, the surface-modified cellulosic material of the present invention may be used to replace or supplement the glass-fibers used to reinforce some polymers. Such substitution reduces the density of the fiber-reinforced material: glass fibers typically have a density of about 2.55 g/cm$^3$, whereas the cellulosic materials surface-modified with a modified SMA copolymer according to some embodiments of the present invention have a density of about 1.5 g/cm$^3$. Thus, the surface-modified cellulosic material according to some embodiments of the present invention may be used to produce strong, lightweight polymer composites having application in various industrial sectors, including, but not limited to the automotive, sporting good, and aerospace sectors where lightweight materials are vital. Accordingly, the present method of producing a surface-modified cellulosic material may enable diversification of the products offered by the forestry industry and/or be used to convert cellulosic waste (for example, from paper products such as paper beverage cups) into a viable product.

The surface-modified cellulosic material produced according to method 10 may be dried before being combined with a hydrophobic material or may be combined with a hydrophobic material when still wet. For example, a surface-modified cellulosic material produced according to method 10 and having a moisture content of about 70 wt % may be added directly to a wet compounding process, including (but not limited to) a Gelimat™-type compounder or a vacuum-assisted twin screw compounder, to combine this material with the desired hydrophobic material. Alternatively, the surface-modified cellulosic material may be first dried using any conventionally-known drying means, including (but not limited to) one or more of air-drying, drying in a conventional paper machine, filtration, centrifugation, ring/flash drying, co-drying with an additional cellulosic material, freeze-drying, spray drying, microwave-assisted drying, vacuum drying, supercritical $CO_2$ drying, solvent exchange drying, solvent drying, dispersion drying, fluid bed drying, through-air drying, and 'mixing drying' (see for example United States Publication No. 2015/0308017). A dry surface-modified cellulosic material may be directly blended in one or more of a powdered, granulated, pelletized, and otherwise solid form with a thermoplastic material prior to or during melt processing. A dry surface-modified cellulosic material may be directly blended in liquid form with a thermoset, such as an epoxy resin. Where incorporation of a dry surface-modified cellulosic material into a synthetic rubber is desired, such a material may be first dispersed within cyclohexane and/or other non-polar solvent (including, but not limited to, one or more of toluene, naptha, and benzene) to facilitate incorporation into synthetic rubber production processes.

In some embodiments, the surface-modified cellulosic material produced according to method 10 is dried using a one-step solvent drying process described elsewhere herein or the one-step solvent drying process combined with other conventional drying methods (including, but not limited to, one or more of ring drying, oven drying, through-air-drying, spray drying, solvent drying, etc.). For example, the surface-modified cellulosic material may be partially dewatered prior to initiating the one-step solvent drying process thereby reducing the total volume of solvent required. In some embodiments, drying the surface-modified cellulosic material enhances the hydrophobic nature of the material and, accordingly, may be beneficial to modification method 10.

In optional block 26 (FIG. 1) the surface-modified cellulosic material is dried using a one-step solvent drying process described elsewhere herein or the one-step solvent drying process combined with other conventional drying methods (including, but not limited to, one or more of ring drying, oven drying, through-air-drying, spray drying, solvent drying, etc.). In some embodiments, an undesirable amount of aggregation of the surface-modified cellulosic material is observed when the material is exclusively dried by oven drying, ring drying, flash drying, fluid bed drying, or other conventional drying processes. In some embodiments, highly fibrillated pulp fibers may aggregate during drying. Aggregation may be reduced by using a carrier fibre (i.e. larger fibers that can hold apart the highly fibrillated cellulosic material). For example, a blend of about 80% conventional pulp fiber (e.g. Kraft pulp, thermomechanical pulp, dissolving pulp, etc.) and about 20% fibrillated fiber may be used instead of directly drying the fibrillated fibers alone.

In block 28 a hydrophobic material is provided and combined with the surface-modified cellulosic material to provide a reinforced hydrophobic commodity, to replace or supplement more expensive and/or more dense and/or less strong materials provided in reinforced hydrophobic commodities, and/or to modify the flow properties of a non-polar solvent.

Figure 3:
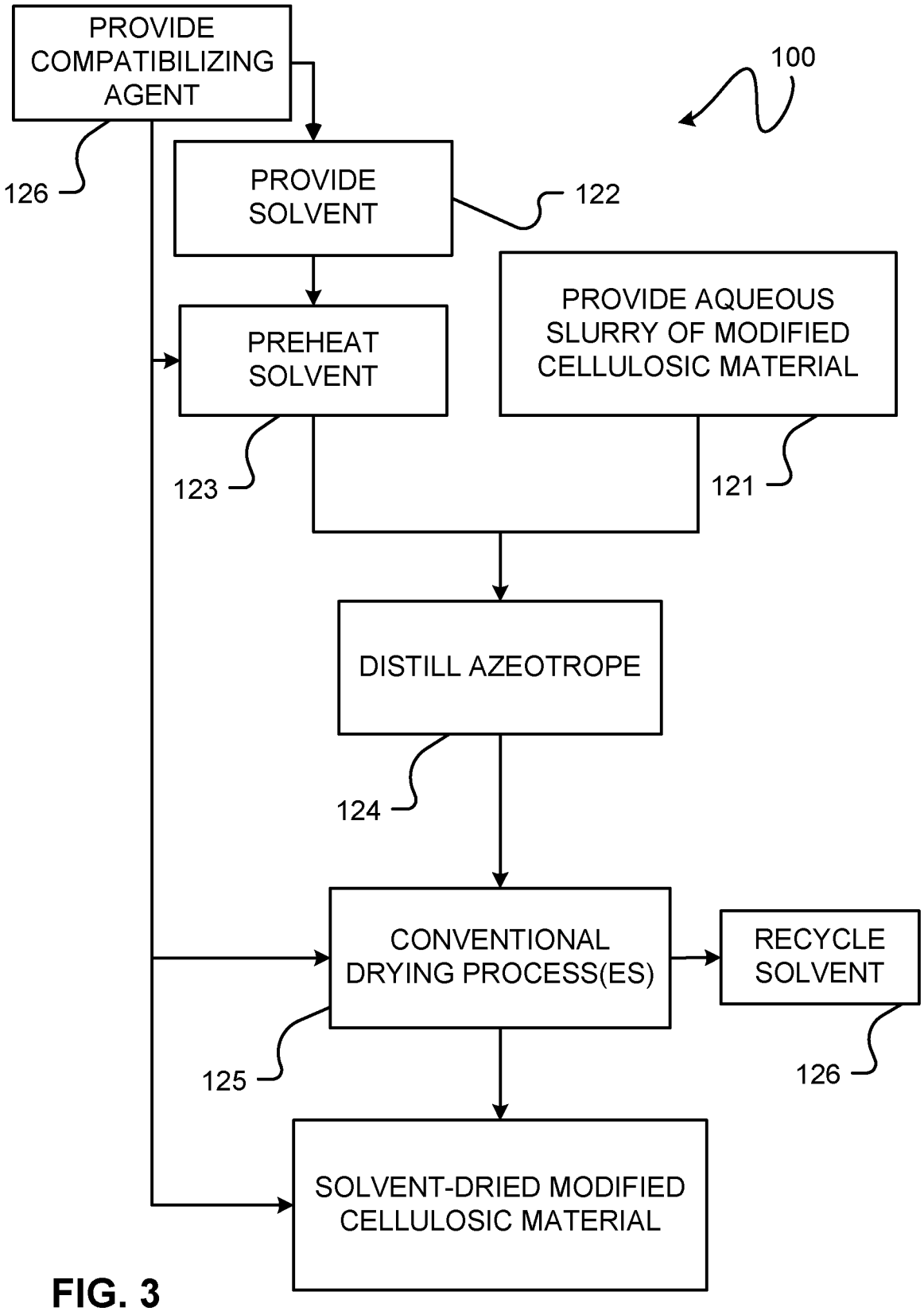
FIG. 3 is a flow chart which illustrates one-step solvent drying methods for drying a surface-modified cellulosic material according to some embodiments of the present invention.

FIG. 3 shows a one-step solvent drying method 100 for drying a modified cellulosic material. In some embodiments, the modified cellulosic material comprises one or more of the surface-modified cellulosic material produced according to method 10, another hydrophobically-modified cellulosic material (such as an alkenyl succinic anhydride (ASA)-modified cellulosic material), and a silylated cellulosic material. In block 121 an aqueous slurry of a modified cellulosic material is prepared. In some embodiments, the solids content of the modified cellulosic material in the aqueous slurry is between about 2 wt % to about 10 wt %.

In block 122 a solvent is provided. The solvent is capable of forming an azeotrope with water and has an azeotropic boiling point lower than the boiling point of the neat solvent. In some embodiments, it may be advantageous for the solvent to have a boiling point higher than the boiling point of water. In some embodiments, the solvent has a boiling point in the range of about 125° C. to about 200° C. In some embodiments, the solvent comprises one or more of xylene, toluene, benzene, n-butyl acetate, pyridine, n-propyl acetate, benzyl alcohol, furfuryl alcohol, cyclohexanol, isobutanol, and n-butanol. In some embodiments, the solvent forms an azeotrope with water and the boiling point of the azeotrope is in the range of about 75° C. to about 95° C.

In optional block 123 the solvent is preheated. Adding the aqueous slurry to a preheated solvent may cause a portion of the water contained in the slurry to rapidly evaporate and/or a water:solvent azeotrope to form.

The aqueous slurry of the modified cellulosic material is combined with the solvent and the solvent forms an azeotrope with water, with the solvent in excess. The azeotrope has a constant boiling point throughout distillation that is lower than the boiling point of the neat solvent. For example, xylene (which has a boiling point of about 140° C.) forms an azeotrope with water that has a boiling point of about 95° C. In block 124, the azeotrope is distilled. Distillation 124 of the azeotrope causes a bulk of the water in solution to evaporate in the form of the azeotrope. Thus, azeotrope formation facilitates drying and may permit efficient dispersion of the modified cellulosic material within the solvent. Dispersion may be achieved by stirring the slurry throughout distillation to separate the individual modified cellulosic material particles. Dispersion may be enhanced during vaporization of the water, whereby water vapour may aid to physically push apart individual modified cellulosic material particles as the water vapour bubbles out of solution. Distillation 124 is performed at atmospheric pressure; however, lower pressures may be used to reduce boiling points.

Any remaining water/solvent may be dried from the modified cellulosic material using one or more conventional drying methods, such as evaporating, decanting, draining, and/or filtering. For example, the modified cellulosic material may be air- or oven-dried following one-step solvent drying according to method 100. In optional block 125, the modified cellulosic material dried according to method 100 is further dried using one or more conventional drying methods (including, but not limited to, one or more of ring drying, flash drying, dispersion drying, fluid bed drying, oven drying, through-air drying, spray drying, solvent drying, etc.) as described elsewhere herein. In some embodiments, the modified cellulosic material is dried by imparting a shear force on the material and directing hot air or gas on the material. For example, in some embodiments, the shear force is supplied by a dispersion unit. Persons skilled in the art will recognize that the dispersion force may be supplied by means conventionally known. In some embodiments, the shear force and the hot air or gas are supplied to the modified cellulosic material simultaneously. In some embodiments, the temperature of the hot air or gas is in the range of about 100° C. to about 180° C. In some embodiments, the temperature of the hot air or gas is greater than or equal to about 200° C. Where higher temperatures (for example, temperatures greater than or equal to about 200° C.) are used, the modified cellulosic material is subjected to the hot air or gas for relatively shorter durations of time than where relatively lower temperatures are used. In this way, the modified cellulosic material is less likely to be destroyed or become damaged by the higher temperatures.

The azeotrope that is distilled from the modified cellulosic material may be collected and condensed to separate the water from the solvent. The solvent may recycled in optional block 126 for re-use with method 100 by optional gravity-separation.

Since one-step solvent drying method 100 uses only one solvent exchange step, the amount of solvent that is required and the number of separation and distillation steps needed to recover the solvent is reduced relative to conventional solvent exchange drying methods. In some embodiments, up to about 200 g of surface-modified cellulosic material may be solvent dried in about 1 L of xylene. Solvent drying more surface-modified cellulosic material in the same volume of solvent may result in a build-up of excess surface modifier in the solvent, causing the surface modifier to aggregate with the surface-modified cellulosic material during drying and prevent proper dispersion of the surface-modified cellulosic material. In some embodiments, the amount of surface-modified cellulosic material that may be solvent dried in a given volume of solvent may be increased by removing excess surface modifier prior to solvent drying (as described elsewhere herein).

Method 100 also produces a solvent-dried modified cellulosic material that is fluffy in appearance and/or exhibits minimal aggregation and/or hornification on drying and/or to possesses a low-density fibrous network that is readily dispersible in a hydrophobic material, such as a thermoset and/or a thermoplastic polymer. Such a material may be used as a strength-reinforcing agent for a hydrophobic commodity, to replace more expensive and/or more dense materials in hydrophobic commodities, and/or as a rheology modifier for a non-polar solvent. The contact angle of solvent-dried modified cellulosic materials may be indeterminable since formation of handsheets for accurate contact angle measurement involves dispersing the solvent-dried modified cellulosic material in water and the material may be prohibitively hydrophobic. Following solvent drying, the surface modifier is present in a range of about 0.05 wt % to about 10 wt % of the modified cellulosic material. The amount of water present in the modified cellulosic material following drying is typically less than about 5 wt %; however, this value may increase over time if the material is present in a humid environment.

In some embodiments, the modified cellulosic material may be treated with a compatibilizing agent to further promote hydrophobicity. For example, if the modified cellulosic material is to be incorporated into a polypropylene composition, then the modified cellulosic material may be treated with a compatibilizing agent. The compatibilizing agent may be any material that is soluble in the solvent used to dry the modified cellulosic material, reactive with the modified cellulosic material, and/or enhances compatibility between the modified cellulosic material and the material it is to be embedded in. For example, the compatibilizing agent may comprise a maleic anhydride-grafted polypropylene copolymer and/or a maleic anhydride polypropylene (MAPP) copolymer. In some embodiments, the compatibilizing agent comprises a reactive copolymer. Modified cellulosic materials treated with a compatibilizing agent are hydrophobic and fluffy in appearance. Contact angle may be indeterminable since water droplets remain suspended in the fluffy solvent-dried modified cellulosic materials and do not have a measurable contact angle. Following solvent drying, the compatibilizing agent is present in an amount of about 5 wt % to about 100 wt % of the modified cellulosic material. The density of a typical solvent-dried modified cellulosic material treated with a compatibilizing agent is about 1.5 g/cm$^3$, however the bulk density of the fluffy solvent-dried modified cellulosic material can be several fold lower.

To treat a modified cellulosic material with a compatibilizing agent, the compatibilizing agent may be added to the solvent of method 100. In optional block 126 a compatibilizing agent is provided. In some embodiments, the compatibilizing agent is added to the solvent and/or to the preheated solvent. The aqueous slurry of a modified cellulosic material is then added to the solvent mixture. In some embodiments, the compatibilizing agent may react with water and is added only once the azeotrope has evaporated. The compatibilizing agent may be added during the compounding of the solvent-dried modified cellulosic material with a thermoset and/or thermoplastic polymer. In some embodiments, the compatibilizing agent is added prior to and/or during alternative drying process (including, but not limited to, one or more ring drying, flash drying, dispersion drying, fluid bed drying, oven drying, through-air drying, spray drying, solvent drying, and any other drying method conventionally known that involves heating above about 100° C. to remove water and enable the compatibilizing agent to react with the cellulosic material).

The solvent-dried modified cellulosic material is a fluffy material having less than about 10 wt % water, preferably less than about 5 wt % water, most preferably less than about 2 wt % water. The material is readily dispersible within one or more of thermosets, thermoplastics, and apolar or non-polar fluids. The material may be dispersed within thermosets and thermoplastics by one or more of dispersing the material within a liquid matrix polymer prior to curing (such as with epoxy and polyurethane foams), blending the material with the thermoset/thermoplastic powder or pellets prior to compounding, and incorporating the material into molten thermoset/thermoplastic prior to or during compounding.

The invention is illustrated by the following non-limiting examples.

Example 1—Surface-Modifying Cellulose Fibrils with Partially DMAPA-Imidized SMA A partially DMAPA-imidized SMA copolymer was prepared by combining an SMA copolymer and DMAPA in a non-reacting diluent. The resulting mixture was heated to about 165° C. for a period of about 2.5 hours. Water was removed during the heating period. The tertiary amine of the resulting DMAPA-imidized SMA copolymer was then protonated by adding acetic acid. The resulting cationic DMAPA-imidized SMA copolymer was water-soluble. When dissolved in water, a cationic aqueous solution was produced. The molecular weight of the partially DMAPA-imidized SMA copolymer was between about 6,500 g/mol and 7,000 g/mol. The ratio of maleic anhydride units to styrene units in the copolymer backbone was about 4:6. The percent of maleic anhydride units imidized with DMAPA was about 95%.

Figure 4B:
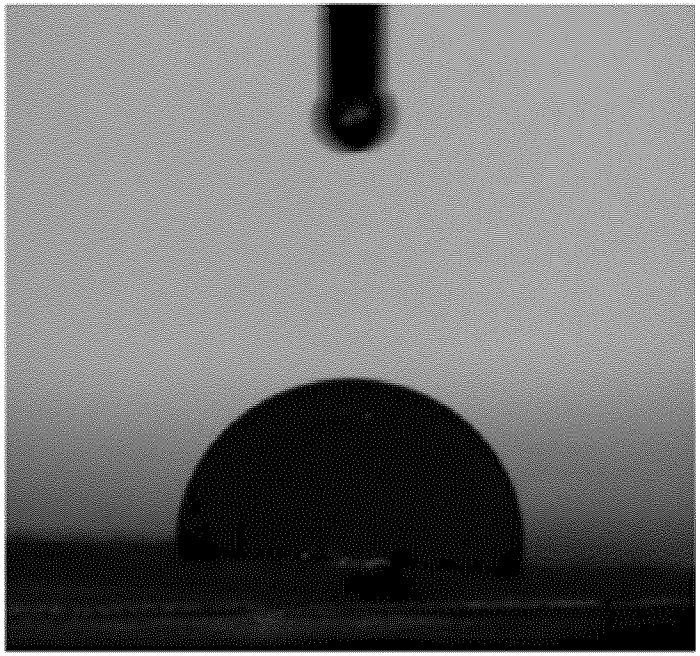
FIG. 4B is an image of a demonstration of the contact angle of a handsheet produced from cellulose fibrils surface-modified with partially DMAPA-imidized SMA copolymer according to an example embodiment of the present invention.
Figure 4A:
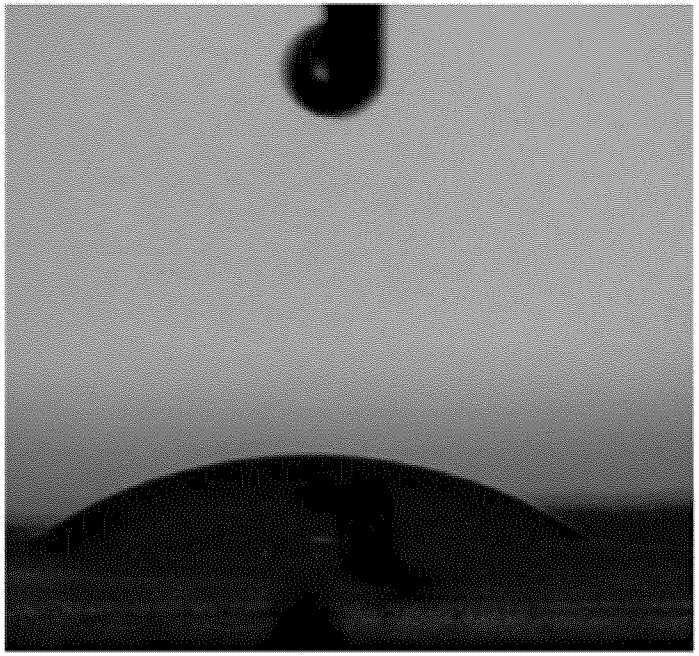
FIG. 4A is an image of a demonstration of the contact angle of a handsheet produced from unmodified cellulose fibrils.

The partially DMAPA-imidized SMA copolymer was added to an aqueous slurry of cellulose fibrils having a pH of about 5. At this pH, the copolymer was soluble in the water. The mixture was stirred at room temperature for about 30 minutes (or until the partially DMAPA-imidized SMA copolymer was well dispersed throughout the cellulose fibrils slurry. Using sodium hydroxide, the pH of the slurry was increased from about 5 to about 8.5 over a period of about 15 minutes with continuous stirring. The mixture was stirred for an additional about 30 minutes to precipitate and deposit the copolymer onto the surface of the cellulose fibrils. The surface-modified cellulose fibrils were then dewatered using centrifugation and filtration to yield a material having a solids content of about 10 wt % to about 20 wt %. The surface modifier was present in the surface-modified cellulose fibrils in an amount within the range of about 1 wt % to about 10 wt %. The contact angle of handsheets produced from the surface-modified cellulose fibrils was then compared to the contact angle of handsheets produced from unmodified cellulose fibrils. Contact angle was measured by conditioning handsheets produced from unmodified cellulose fibrils and handsheets produced from surface-modified cellulose fibrils in a controlled temperature (20° C.) and humidity (50%) room for at least about 24 hours. As shown in FIG. 4A, the contact angle of unmodified cellulose fibrils was about 40°. As shown in FIG. 4B, the contact angle of cellulose fibrils surface-modified with partially DMAPA-imidized SMA copolymer was about 105°. The greater contact angle indicates that the surface-modified cellulose fibrils displayed enhanced hydrophobicity over the unmodified cellulose fibrils.

Example 2—Solvent-Dried Surface-Modified Cellulose Fibrils

Figure 5B:
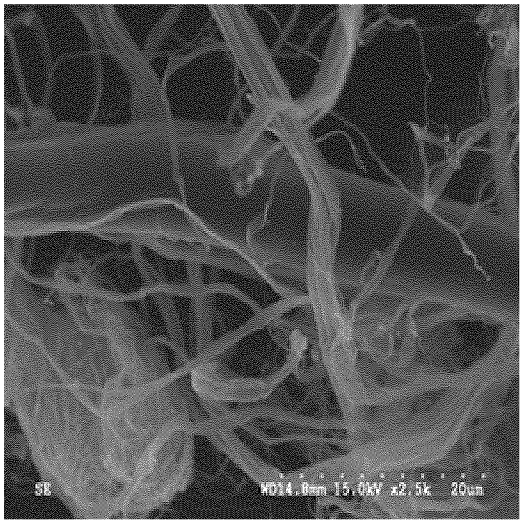
FIG. 5B is an image of the solvent-dried surface-modified cellulose fibrils shown in FIG. 5A (magnification: 2,500×).
Figure 5A:
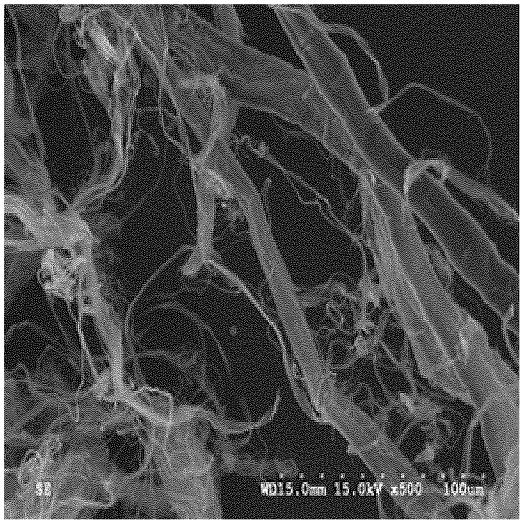
FIG. 5A is an image of solvent-dried surface-modified cellulose fibrils (magnification: 500×) according to an example embodiment of the present invention.
Figure 6B:
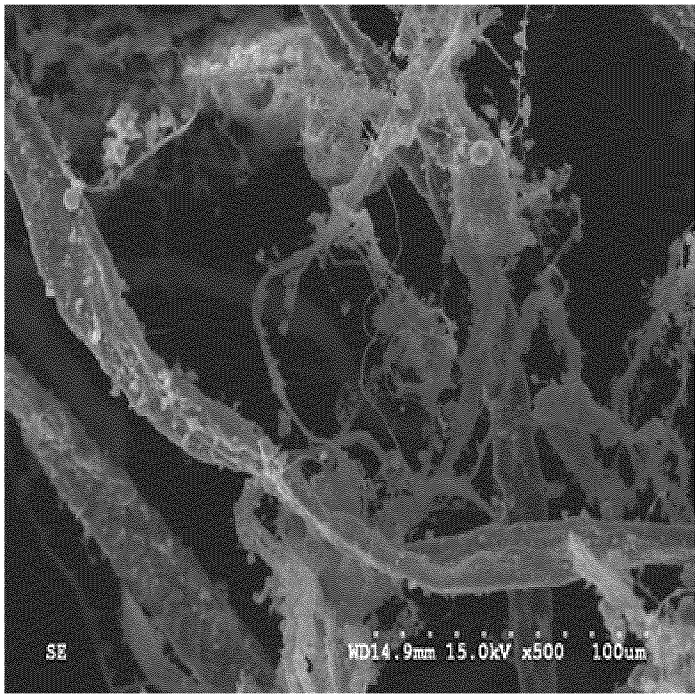
FIG. 6B is an image of the surface-modified cellulose fibrils (magnification: 500×) shown in FIG. 6A.
Figure 6A:
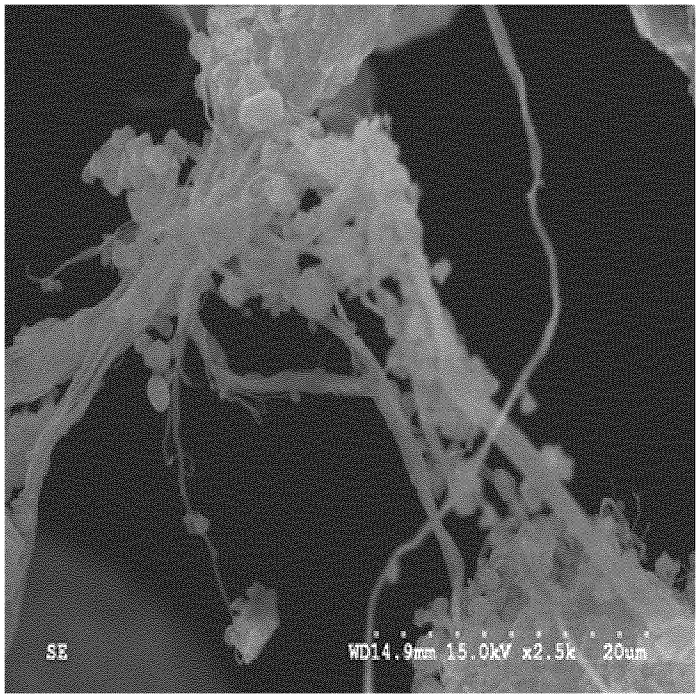
FIG. 6A is an image of surface-modified cellulose fibrils solvent-dried in the presence of MAPP (magnification: 2,500×) according to an example embodiment of the present invention.
Figure 7A:
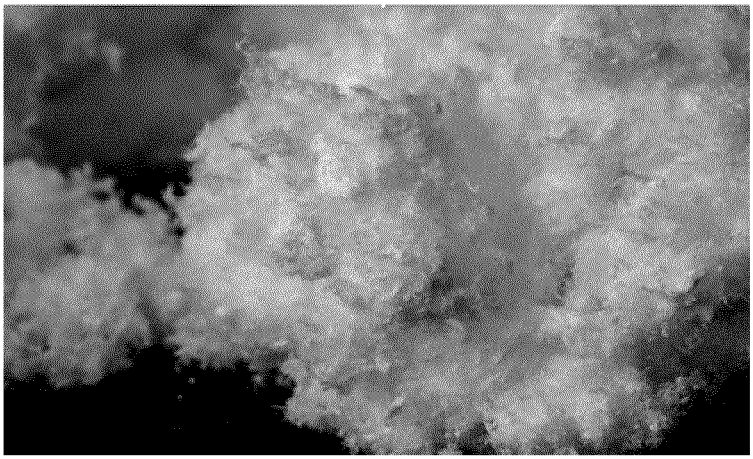
FIG. 7A is an image of surface-modified cellulose fibrils solvent-dried in the presence of MAPP (magnification: about 2×) according to an example embodiment of the present invention.
Figure 7B:
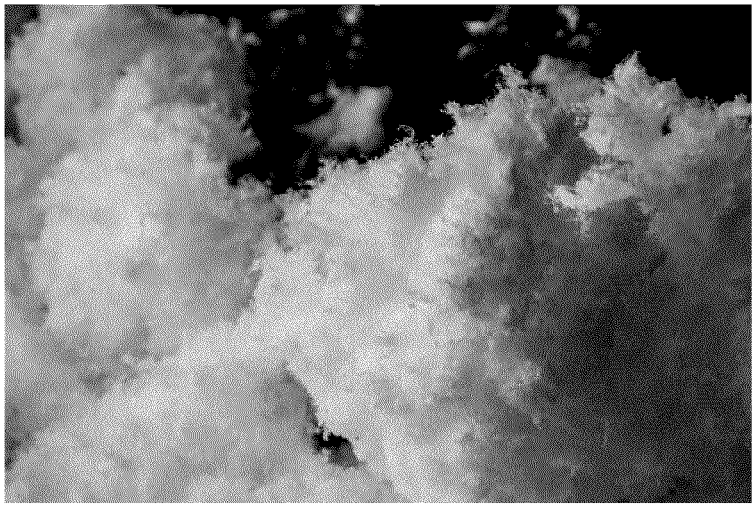
FIG. 7B is an image of the surface-modified cellulose fibrils (magnification: about 2×) shown in FIG. 7A.
Figure 7C:
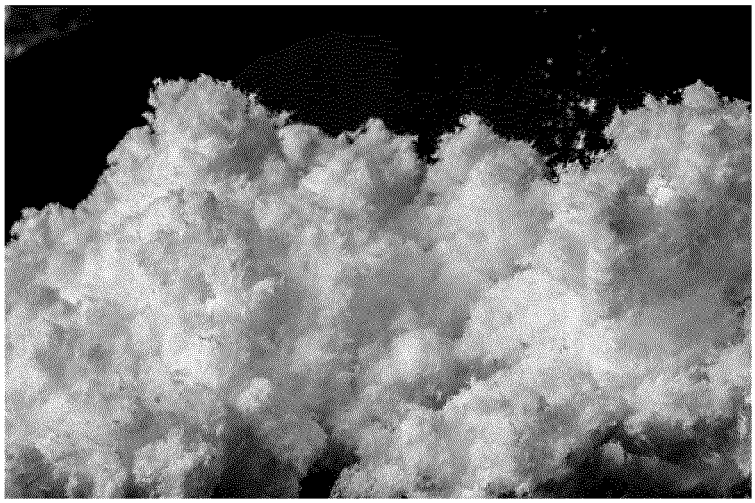
FIG. 7C is an image of the surface-modified cellulose fibrils (magnification: about 2×) shown in FIG. 7A.

The surface-modified cellulose fibrils produced in Example 1 were dried according to method 100. Xylene was preheated to a temperature of 139° C. An aqueous slurry having 10 wt % surface-modified cellulose fibrils was added to the hot xylene. The resulting solution consisted of 1 wt % surface-modified cellulose fibrils, 9 wt % water, and 90 wt % xylene. An azeotrope formed, which was distilled at about 90° C. for about 30 minutes. Once the azeotrope was completely evaporated, the temperature of the solution quickly rose to 139° C. Residual xylene was then decanted and the modified cellulose fibrils allowed to air dry at about 60° C. for about 1 hour. It can be seen from FIGS. 5A and 5B that the individual, solvent-dried surface-modified cellulose fibrils possess good separation with minimal aggregation/hornification.

Example 3—Surface-Modified Cellulose Fibrils Solvent-Dried in the Presence of MAPP FIGS. 6A, 6B, 7A, 7B, and 7C show the surface-modified cellulose fibrils produced in Example 1 and solvent dried according to method 100 in the presence of MAPP. An aqueous slurry having 10 wt % surface-modified cellulose fibrils was added to the xylene. The resulting solution consisted of 1 wt % surface-modified cellulose fibrils, 9 wt % water, and 90 wt % xylene. An azeotrope formed, which was distilled at about 90° C. for about 30 minutes. Once the azeotrope was completely evaporated, the temperature of the solution quickly rose to 139° C. 50 wt % MAPP (relative to the modified cellulose fibrils) was then added and dissolved in the hot xylene solution and the temperature was maintained at 139° C. for about 30 minutes. Residual xylene with excess dissolved MAPP was then decanted. The surface-modified cellulose fibrils were rinsed once with hot (>100° C.) xylene and then allowed to air dry at about 60° C. for about 1 hour. As can be seen from FIGS. 6A and 6B, small particles of MAPP were precipitated onto the surface of the solvent-dried surface-modified cellulose fibrils. It can also be seen from FIGS. 7A, 7B, and 7C that the solvent-dried surface-modified cellulose fibrils are very fluffy.

Surface modification of the cellulose fibrils enables the fibrils to be fully dispersed in an anhydrous environment prior to addition of the compatibilizing agent (i.e. MAPP) following azeotrope distillation. Addition of the compatibilizing agent following azeotrope distillation prevents the anhydride units of MAPP from reacting with water, which would prevent MAPP from crosslinking with the cellulose fibrils.

Figure 8B:
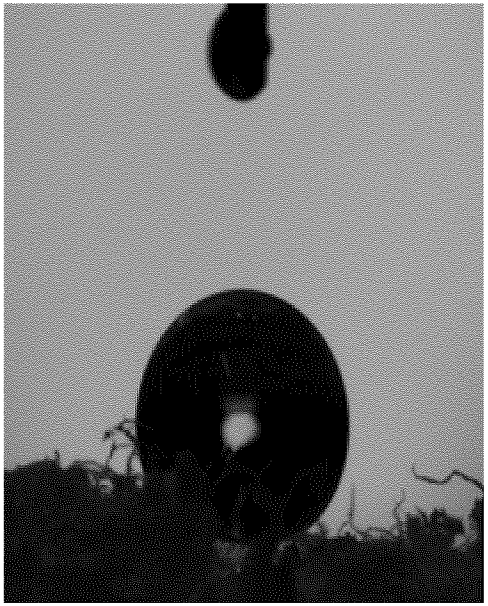
FIG. 8B is an image of a demonstration of the contact angle of surface-modified cellulose fibrils solvent-dried in the presence of MAPP in fluffy form according to an example embodiment of the present invention.
Figure 8A:
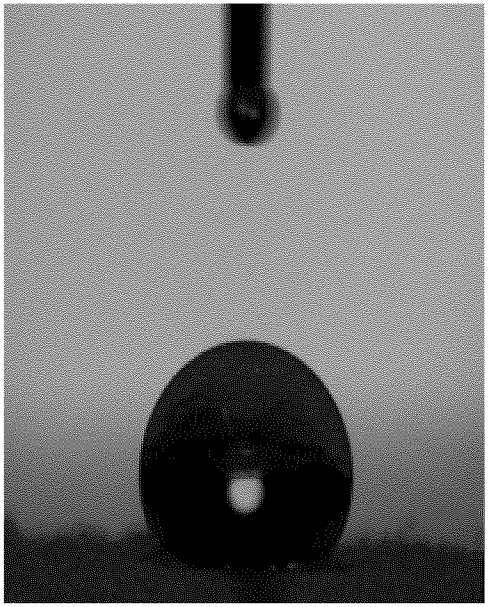
FIG. 8A is an image of a demonstration of the contact angle of surface-modified cellulose fibrils solvent-dried in the presence of MAPP in handsheet form according to an example embodiment of the present invention.

The contact angles of the solvent-dried surface-modified cellulose fibrils in 'flat-pressed sheets' and 'fluff' form were then determined. The flat-pressed sheets were prepared by pressing the solvent-dried surface-modified cellulose fibrils into a flat disc and conditioned in a controlled temperature (20° C.) and humidity (50%) room for at least about 24 hours. As shown in FIG. 8A, the contact angle of the solvent-dried surface-modified cellulose fibrils in flat-pressed sheet form was about 145°, indicating the high hydrophobicity of these fibrils. As shown in FIG. 8B, the contact angle of the solvent-dried surface-modified cellulose fibrils in fluff form was not measurable. Nonetheless, the liquid bead at the surface of these fibrils appears to sit on top of the material indicating exceptionally high hydrophobicity.

Example 4—Oven-Dried Surface-Modified Cellulosic Material

Figure 9:
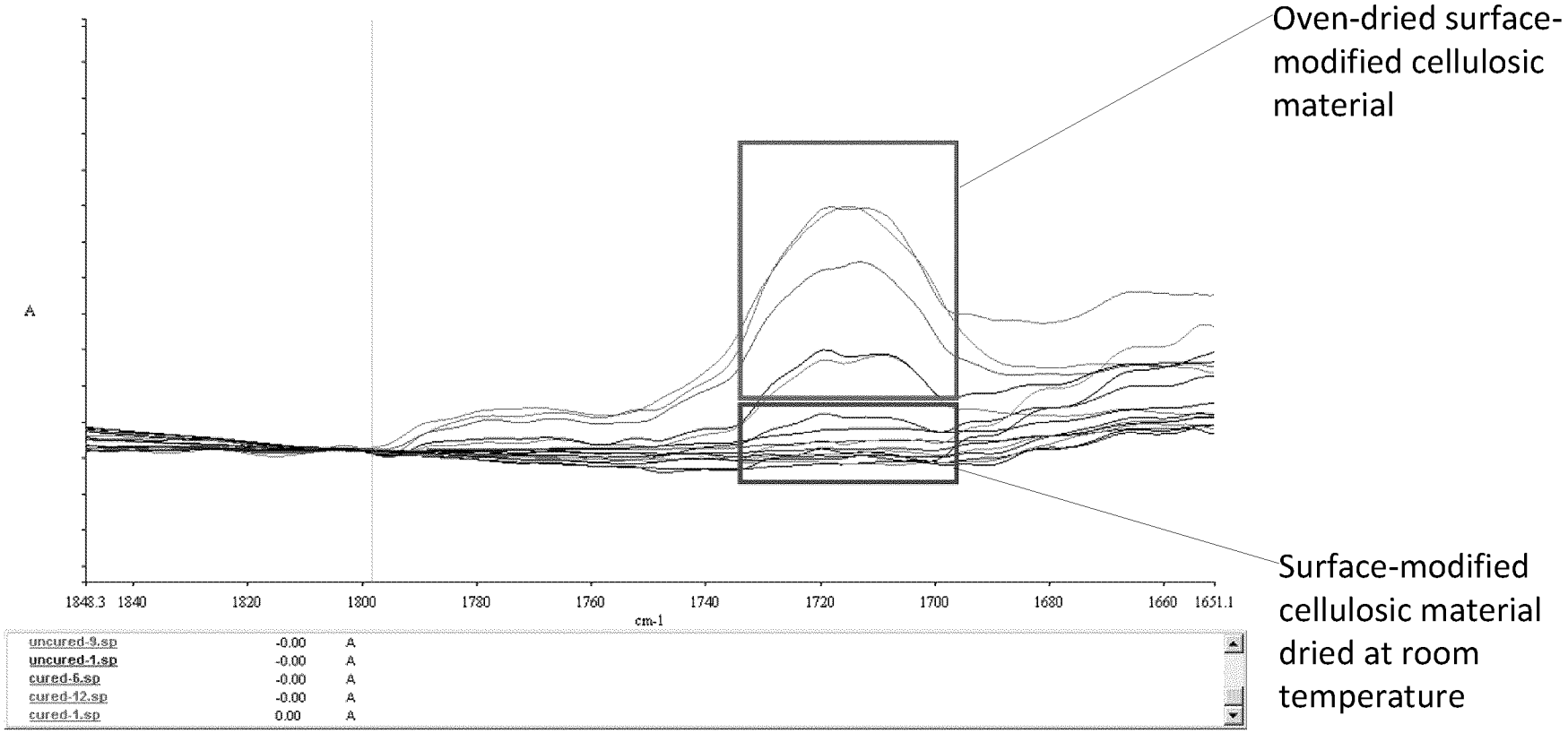
FIG. 9 is a Fourier transform infrared spectroscopy (FTIR) spectra of an oven-dried surface-modified cellulosic material and an air-dried surface-modified cellulosic material.

FIG. 9 shows FTIR spectra of two samples of cellulose fibrils surface modified with partially DMAPA-imidized SMA copolymer (MW about 6,500 g/mol to about 7,000 g/mol, about 4:6 ratio of maleic anhydride units to styrene units in the copolymer backbone, about 95% of maleic anhydride units imidized with DMAPA). The spectra were recorded on a spectrophotometer (Perkin Elmer, Wellesley, Mass.) equipped with a ZnSe window by averaging 32 scans in the frequency range of 4,000 $cm^{-1}$ to 400 $cm^{-1}$ at 4 $cm^{-1}$ resolution The first (control) sample was air dried at room temperature. The second sample was oven dried at a temperature of 105° C. overnight. The FTIR spectra of the second sample show a peak at about 1715 $cm^{-1}$. The FTIR spectra of the first sample lack this peak. Without being bound by theory, it is speculated that when oven-dried, the surface modifier interacts with the surface of the cellulosic material through an esterification reaction between the anhydride groups of the surface modifier and the hydroxyl groups of the cellulosic material. The peak at about 1715 $cm^{-1}$ in the FTIR spectra of the second sample is thought to correspond to the ester group formed between the anhydride group of the surface modifier and the hydroxyl group of the cellulosic material.

Figure 10A:
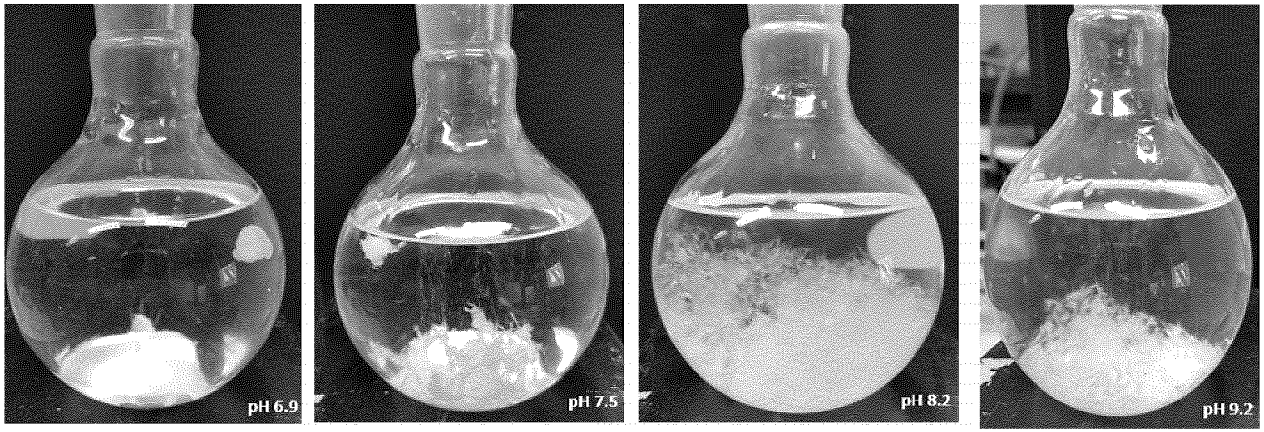
FIG. 10A is photographs of slurries of cellulose fibrils modified with DMAPA-imidized SMA in xylene, wherein the surface-modified cellulosic materials were prepared at various pH values.
Figure 10B:
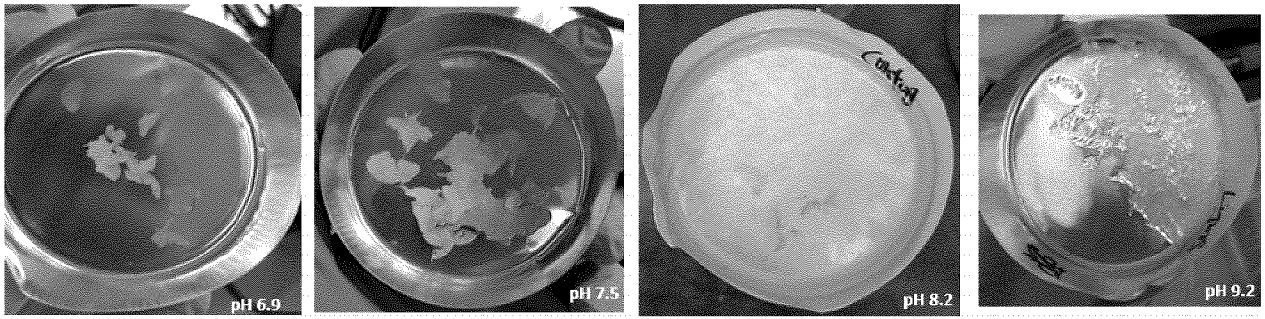
FIG. 10B is photographs of dispersions of surface-modified cellulosic materials in xylene, wherein the surface-modified cellulosic materials were prepared at various pH values.

Example 5—Surface-Modifying Cellulose Fibrils with Partially DMAPA-Imidized SMA at Various pH A partially DMAPA-imidized SMA copolymer (MW about 6,500 g/mol to about 7,000 g/mol, about 4:6 ratio of maleic anhydride units to styrene units in the copolymer backbone, about 95% of maleic anhydride units imidized with DMAPA) prepared as described in Example 1 was added to aqueous slurries of cellulose fibrils. Each slurry contained about 5 wt % cellulose fibrils and about 2.5 wt % partially DMAPA-imidized SMA (i.e. about a 2:1 ratio of cellulose fibrils to partially DMAPA-imidized SMA). By adding sodium hydroxide, the pH of the slurries was adjusted to the following pH values shown in FIG. 10A: (i) 6.9; (ii) 7.5; (iii) 8.2; and (iv) 9.2. At a pH of about 8.2 and higher, the partially DMAPA-imidized SMA precipitated. The slurries were then added to xylene preheated to a temperature of about 139° C. (i.e. about the boiling point of xylene). About 1 g of each slurry was added to about 100 mL of the preheated xylene, as shown in FIG. 10A. The xylene formed an azeotrope with the water in the slurries. The azeotrope, having a boiling point less than the boiling point of xylene, was distilled from the mixture. Excess xylene was decanted from the surface-modified cellulosic materials and the materials transferred to metal sample trays. FIG. 10B shows the dispersion of the surface-modified cellulosic materials in the residual xylene. As seen in FIG. 10B, dispersion improved by adjusting the pH of the slurry to about 8.2 and higher. Without being bound by theory, it is speculated that precipitation of the surface modifier enhances the dispersion of the surface-modified cellulosic material.

Figure 11A:
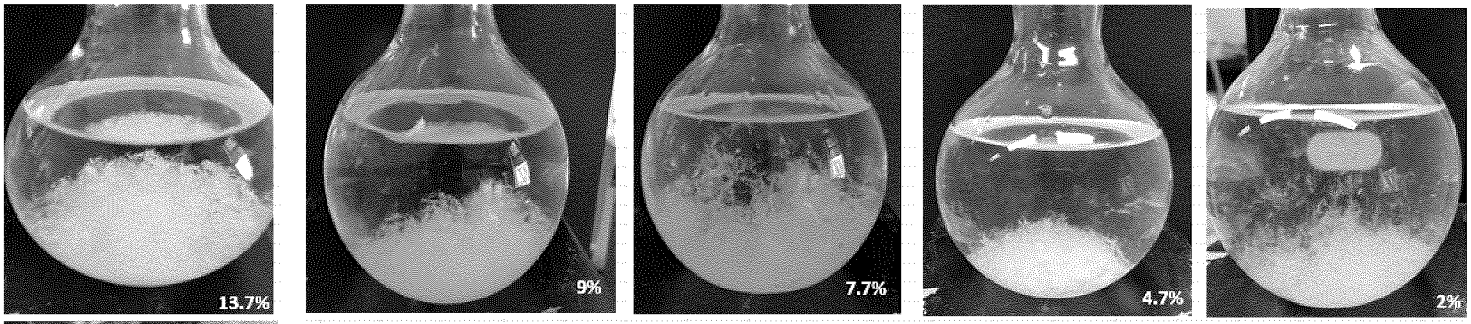
FIG. 11A is photographs of slurries of cellulose fibrils and DMAPA-modified imidized SMA in xylene, wherein the surface-modified cellulosic materials were prepared at a range of cellulosic material wt % consistencies.
Figure 11B:
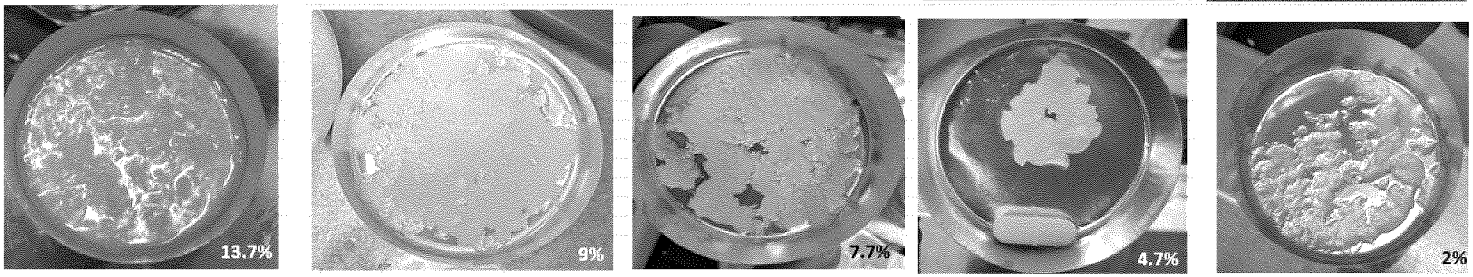
FIG. 11B is photographs of dispersions of surface-modified cellulosic materials in xylene, wherein the surface-modified cellulosic materials were prepared at a range of cellulosic material wt % consistencies.

Example 6—Surface-Modifying Various Wt % Slurries of Cellulose Fibrils with Partially DMAPA-Imidized SMA A partially DMAPA-imidized SMA copolymer (MW about 6,500 g/mol to about 7,000 g/mol, about 4:6 ratio of maleic anhydride units to styrene units in the copolymer backbone, about 95% of maleic anhydride units imidized with DMAPA) prepared as described in Example 1 was added to aqueous slurries of cellulose fibrils. As shown in FIG. 11A, the various slurries of cellulose fibrils contained about: (i) 13.7 wt % cellulose fibrils; (ii) 9.0 wt % cellulose fibrils; (iii) 7.7 wt % cellulose fibrils; (iv) 4.7 wt % cellulose fibrils; and (iv) 2.0 wt % cellulose fibrils. The slurries each contained about 50 wt % DMAPA-modified imidized SMA (relative to the wt % of cellulose fibrils in each slurry). The pH of each slurry was adjusted to about 8.5 by adding sodium hydroxide. The slurries were then added to xylene preheated to a temperature of about 139° C. (i.e. about the boiling point of xylene). About 1 g of the slurry was added to about 100 mL of the preheated xylene. The xylene formed an azeotrope with the water in the slurries. The azeotrope, having a boiling point less than the boiling point of xylene, was distilled from the mixture. Excess xylene was decanted from the surface-modified cellulosic materials and the materials transferred to metal sample trays. FIG. 11B shows the dispersion of the surface-modified cellulosic materials in the residual xylene. Dispersion of the surface-modified cellulosic materials improved as the wt % of the cellulose fibrils in the aqueous slurry decreased from about 13.7 wt % to about 2.0 wt %. The surface-modified cellulosic material yielded from the slurry containing about 13.7 wt % cellulose fibrils did not disperse and several aggregates formed. The surface-modified cellulosic material yielded from the slurry containing about 9.0 wt % cellulose fibrils formed several aggregates. The surface-modified cellulosic material yielded from the slurry containing about 7.7 wt % dispersed in the hydrophobic solvent within about 3 minutes. The surface-modified cellulosic material yielded from the slurry containing about 4.7 wt % cellulose fibrils dispersed in the hydrophobic solvent within about 2 minutes. This surface-modified cellulose material appeared to be 'fluffy'. The surface-modified cellulosic material yielded from the slurry containing about 2.0 wt % cellulose fibrils dispersed in the hydrophobic solvent within less than about 1 minute. This surface-modified cellulose material appeared to be 'fluffiest'. The smallest particles were formed with this surface-modified cellulose material.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the connection or coupling between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Where a component (e.g. a substrate, assembly, device, manifold, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments described herein.

Specific examples of systems, methods, and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A method of producing a surface-modified cellulosic material in a fibrous/pulp form for internal sizing, the method comprising:

providing a slurry of a cellulosic material in a fibrous/pulp form;

adding a styrene-co-maleic anhydride copolymer to the slurry; and adjusting the pH of the slurry by adding a base to precipitate the styrene-co-maleic anhydride copolymer onto the surface of the cellulosic material, wherein the styrene-co-maleic anhydride copolymer interacts with the surface of the cellulosic material.

2. A method according to claim 1, wherein adding the styrene-co-maleic anhydride copolymer comprises adding a solution of the styrene-co-maleic anhydride copolymer to the slurry.

3. A method according to claim 1, wherein the styrene-co-maleic anhydride copolymer comprises a modified styrene-co-maleic anhydride (SMA) copolymer.

4. A method according to claim 3, wherein the molecular weight of the styrene-co-maleic anhydride copolymer is between about 4,000 g/mol and about 10,000 g/mol.

5. A method according to claim 3, wherein the styrene-co-maleic anhydride copolymer comprises modified maleic anhydride units.

6. A method according to claim 5, wherein the maleic anhydride units are at least partially imidized.

7. A method according to claim 6, wherein the styrene-co-maleic anhydride copolymer comprises a dimethylaminepropylamine (DMAPA)-imidized SMA copolymer.

8. A method according to claim 7, wherein the DMAPA-imidized SMA copolymer is solubilized in water by adding an acetic acid.

9. A method according to claim 7, wherein between about 25% and about 100% of the maleic anhydride units of the SMA copolymer are DMAPA-imidized.

10. A method according to claim 7, wherein the DMAPA-imidized SMA copolymer is precipitated from the slurry at a pH of about 8.5.

11. A method according to claim 1, further comprising controlling a temperature of the slurry to within about 10° C. to about 40° C. before adding the surface modifier.

12. A method according to claim 1, further comprising drying a surface-modified cellulosic material, wherein drying the surface-modified cellulosic material consists of one or more of the following: filtration, centrifugation, flash drying, co-drying with an unmodified cellulosic material, freeze-drying, spray drying, microwave-assisted drying, vacuum drying, ring drying, fluid bed drying, oven drying, through-air drying, dispersion drying, mixing drying, and solvent drying.

13. A method according to claim 1, further comprising one-step solvent drying a surface-modified cellulosic material, wherein the one-step solvent drying the surface-modified cellulosic material comprises:

providing an aqueous slurry of the surface-modified cellulosic material;

adding the aqueous slurry of the surface-modified cellulosic material to a solvent, wherein the solvent forms an azeotrope having a boiling point that is lower than the boiling point of the solvent; and distilling the slurry to remove the azeotrope from the surface-modified cellulosic material.

14. A method according to claim 1, wherein the surface-modified cellulosic material is fibrillated.

* * * * *